US007974774B2

(12) United States Patent
Kumar

(10) Patent No.: US 7,974,774 B2
(45) **Date of Patent: *Jul. 5, 2011**

(54) TRIP OPTIMIZATION SYSTEM AND METHOD FOR A VEHICLE

(75) Inventor: Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 835 days.

This patent is subject to a terminal disclaimer.

(21) Appl. No.: 11/671,533

(22) Filed: Feb. 6, 2007

(65) Prior Publication Data

US 2007/0233364 A1 Oct. 4, 2007

Related U.S. Application Data

(63) Continuation-in-part of application No. 11/385,354, filed on Mar. 20, 2006.

(60) Provisional application No. 60/870,562, filed on Dec. 18, 2006.

(51) Int. Cl.
*G06G 7/76* (2006.01)

(52) U.S. Cl. ..... 701/123; 701/19; 123/205; 123/525; 123/575; 340/438

(58) Field of Classification Search ..... 701/200, 701/123, 19; 123/525
See application file for complete search history.

(56) References Cited

U.S. PATENT DOCUMENTS 3,519,805 A 7/1970 Thorne-Booth
3,650,216 A 3/1972 Harwick et al.
3,655,962 A 4/1972 Koch
3,865,042 A 2/1975 DePaola et al.
4,005,838 A 2/1977 Grundy
4,041,283 A 8/1977 Mosier
4,042,810 A 8/1977 Mosher
4,181,943 A 1/1980 Mercer, Sr. et al.
4,253,399 A 3/1981 Spigarelli
4,279,395 A 7/1981 Boggio et al.
4,344,364 A 8/1982 Nickles et al.
4,401,035 A 8/1983 Spigarelli et al.
4,561,057 A 12/1985 Haley, Jr. et al.
4,602,335 A 7/1986 Perlmutter
4,711,418 A 12/1987 Aver, Jr. et al.
4,735,385 A 4/1988 Nickles et al.
4,794,548 A 12/1988 Lynch et al.

(Continued)

FOREIGN PATENT DOCUMENTS

EP 1 136 969 9/2001

(Continued)

*Primary Examiner* — Mark Hellner
*Assistant Examiner* — Redhwan Mawari
(74) *Attorney, Agent, or Firm* — Robert Wawrzyn, Esq.; Cian G. O'Brien, Esq.; Beusse Wolter Sanks Mora & Maire, P.A.

(57) ABSTRACT

A system for operating a vehicle including an engine operating on at least one type of fuel is provided. The system includes a locator element to determine a location of the vehicle, a characterization element to provide information about a terrain of the vehicle, a database to store characteristic information for each type of fuel, and a processor operable to receive information from the locator element, the characterization element, and the database. An algorithm is embodied within the processor with access to the information for creating a trip plan that optimizes performance of the vehicle in accordance with one or more operational criteria for the vehicle.

4 Claims, 14 Drawing Sheets

U.S. PATENT DOCUMENTS 4,827,438 A 5/1989 Nickles et al.
4,853,883 A 8/1989 Nickles et al.
5,109,343 A 4/1992 Budway
5,398,894 A 3/1995 Pascoe
5,437,422 A 8/1995 Newman
5,440,489 A 8/1995 Newman
5,676,059 A 10/1997 Alt
5,744,707 A 4/1998 Kull
5,758,299 A 5/1998 Sandborg et al.
5,785,392 A 7/1998 Hart
5,828,979 A 10/1998 Polivka et al.
5,950,967 A 9/1999 Montgomery
6,112,142 A 8/2000 Shockley et al.
6,125,311 A 9/2000 Lo
6,144,901 A 11/2000 Nickles et al.
6,269,034 B1 7/2001 Shibuya
6,308,117 B1 10/2001 Ryland et al.
6,487,488 B1 11/2002 Peterson, Jr. et al.
6,505,103 B1 1/2003 Howell et al.
6,516,727 B2 2/2003 Kraft
6,591,758 B2 7/2003 Kumar
6,609,049 B1 8/2003 Kane et al.
6,612,245 B2 9/2003 Kumar et al.
6,612,246 B2 9/2003 Kumar
6,615,118 B2 9/2003 Kumar
6,691,957 B2 2/2004 Hess, Jr. et al.
6,694,231 B1 2/2004 Rezk
6,732,023 B2 5/2004 Sugita et al.
6,763,291 B1 7/2004 Houpt et al.
6,789,005 B2 9/2004 Hawthorne
6,810,312 B2 10/2004 Jammu et al.
6,824,110 B2 11/2004 Kane et al.
6,845,953 B2 1/2005 Kane et al.
6,853,888 B2 2/2005 Kane et al.
6,856,865 B2 2/2005 Hawthorne
6,863,246 B2 3/2005 Kane et al.
6,865,454 B2 3/2005 Kane et al.
6,903,658 B2 6/2005 Kane et al.
6,915,191 B2 7/2005 Kane et al.
6,922,619 B2 7/2005 Baig et al.
6,957,131 B2 10/2005 Kane et al.
6,978,195 B2 12/2005 Kane et al.
6,980,894 B1 12/2005 Gordon et al.
6,996,461 B2 2/2006 Kane et al.
7,021,588 B2 4/2006 Hess, Jr. et al.
7,021,589 B2 4/2006 Hess, Jr. et al.
7,024,289 B2 4/2006 Kane et al.
7,036,774 B2 5/2006 Kane et al.
7,079,926 B2 7/2006 Kane et al.
7,092,800 B2 8/2006 Kane et al.
7,092,801 B2 8/2006 Kane et al.
2002/0059075 A1 5/2002 Schick et al.
2002/0096081 A1 7/2002 Kraft
2003/0213875 A1 11/2003 Hess, Jr. et al.
2004/0133315 A1* 7/2004 Kumar et al. ..... 700/302
2004/0172175 A1 9/2004 Julich et al.
2004/0245410 A1 12/2004 Kisak et al.
2005/0065674 A1 3/2005 Houpt et al.
2005/0120904 A1 6/2005 Kumar et al.
2005/0121005 A1* 6/2005 Edwards ..... 123/525
2007/0219680 A1* 9/2007 Kumar et al. ..... 701/19

FOREIGN PATENT DOCUMENTS

EP 1136969 A2 * 9/2001
EP 1 297 982 4/2003

* cited by examiner

TRIP OPTIMIZATION SYSTEM AND METHOD FOR A VEHICLE

CROSS-REFERENCE TO RELATED APPLICATIONS

This application claims priority and relates back to co-pending U.S. Application No. 60/870,562 filed on Dec. 18, 2006. Additionally, this application is a continuation-in-part of co-pending U.S. application Ser. No. 11/385,354 filed on Mar. 20, 2006.

FIELD OF THE INVENTION

The field of the invention relates to optimizing vehicle operations, and more particularly to monitoring and controlling a vehicle's operations to improve efficiency while satisfying schedule constraints.

BACKGROUND OF THE INVENTION

Locomotives are complex systems with numerous subsystems, with each subsystem being interdependent on other subsystems. An operator is aboard a locomotive to ensure the proper operation of the locomotive and its associated load of freight cars. In addition to ensuring proper operations of the locomotive the operator also is responsible for determining operating speeds of the train and forces within the train that the locomotives are part of. To perform this function, the operator generally must have extensive experience with operating the locomotive and various trains over the specified terrain. This knowledge is needed to comply with prescribable operating speeds that may vary with the train location along the track. Moreover, the operator is also responsible for assuring in-train forces remain within acceptable limits.

However, even with knowledge to assure safe operation, the operator cannot usually operate the locomotive so that the fuel consumption is minimized for each trip. For example, other factors that must be considered may include emission output, operator's environmental conditions like noise/vibration, a weighted combination of fuel consumption and emissions output, etc. This is difficult to do since, as an example, the size and loading of trains vary, locomotives and their fuel/emissions characteristics are different, and weather and traffic conditions vary. Operators could more effectively operate a train if they were provided with a means to determine the best way to drive the train on a given day to meet a required schedule (arrival time) while using the least fuel possible, despite sources of variability.

In addition to trains having locomotives operating on a single fuel type, it would be advantageous to utilize a train/locomotive and other vehicles including OHV's (off highway vehicles) and marine vehicles having engines which operate on a plurality of fuels including at least one diesel fuel and at least one alternate fuel. In addition to the cost and availability benefits of alternate fuels, the characteristics of each type of fuel and their relative mixes in the operation of each vehicle may be incorporated into determining the best way to operate each vehicle to meet a required schedule while minimizing the total amount of fuel used or minimizing the total emission output, for example.

BRIEF DESCRIPTION OF THE INVENTION

One embodiment of the invention discloses a system for operating a train having one or more locomotive consists with each locomotive consist comprising one or more locomotives. In an exemplary embodiment, the system comprises a locator element to determine a location of the train. A track characterization element to provide information about a track is also provided. The system also has a processor operable to receive information from the locator element, and the track characterizing element. An algorithm is also provided which is embodied within the processor having access to the information to create a trip plan that optimizes performance of the locomotive consist in accordance with one or more operational criteria for the train.

Another embodiment of the present invention also discloses a method for operating a train having one or more locomotive consists with each locomotive consist comprising one or more locomotives. The method comprises determining a location of the train on a track. The method also determines a characteristic of the track. The method further creates a trip plan based on the location of the train, the characteristic of the track, and the operating condition of the locomotive consist in accordance with at least one operational criteria for the train.

Another embodiment of the present invention also discloses a computer software code for operating a train having a computer processor and one or more locomotive consists with each locomotive consist comprising one or more locomotives. The computer software code comprises a software module for creating a trip plan based on the location of the train, the characteristic of the track, and the operating condition of the locomotive consist in accordance with at least one operational criteria for the train.

Another embodiment of the present invention further discloses a method for operating a train having one or more locomotive consists with each locomotive consist comprising one or more locomotives where a trip plan has been devised for the train. The method comprises determining a power setting for the locomotive consist based on the trip plan. The method also operates the locomotive consist at the power setting. Actual speed of the train, actual power setting of the locomotive consist, and/or a location of the train is collected. Actual speed of the train, actual power setting of the locomotive consist, and/or a location of the train is compared to the power setting.

Another embodiment of the present invention further discloses a method for operating a train having one or more locomotive consists with each locomotive consist comprising one or more locomotives where a trip plan has been devised for the train based on assumed operating parameters for the train and/or the locomotive consist. The method comprises estimating train operating parameters and/or locomotive operating parameters. The method further comprises comparing the estimated train operating parameters and/or the locomotive consist operating parameters to the assumed train operating parameters and/or the locomotive consist operating parameters.

Another embodiment of the present invention further discloses a method for operating a train having one or more locomotive consists with each locomotive consist comprising one or more locomotives where a trip plan has been devised for the train based on a desired parameter. The method comprises determining operational parameters of the train and/or the locomotive consist, determining a desired parameter based on determined operational parameters, and comparing the determined parameter to the operational parameters. If a difference exists from comparing the determined parameter to the operational parameters, the method further comprises adjusting the trip plan.

Another embodiment of the present invention further discloses a method for operating a rail system having one or more locomotive consists with each locomotive consist comprising one or more locomotives. The method comprises determining a location of the train on a track and determining a characteristic of the track. The method further comprises generating a driving plan for at least one of the locomotives based on the locations of the rail system, the characteristic of the track, and/or the operating condition of the locomotive consist, in order to minimize fuel consumption by the rail system.

Another embodiment of the present invention further discloses a method for operating a rail system having one or more locomotive consists with each locomotive consist comprising one or more locomotives. Towards this end the method comprises determining a location of the train on a track, and determining a characteristic of the track. The method further comprises providing propulsion control for the locomotive consist in order to minimize fuel consumption by the rail system.

In another embodiment of the present invention, a system for operating a vehicle is provided, where the vehicle includes an engine operating on at least one type of fuel. The system includes a locator element to determine a location of the vehicle, and a track characterization element to provide information about a terrain of the vehicle. More particularly, the system includes a database to store characteristic information for each type of fuel and a processor operable to receive information from the locator element, the track characterization element, and the database. An algorithm is embodied within the processor with access to the information to create a trip plan that optimizes performance of the vehicle in accordance with one or more operational criteria for the vehicle.

In another embodiment of the present invention, a method for operating a vehicle is provided, where the vehicle includes an engine operating on at least one type of fuel. The method includes determining the location of the vehicle, providing information about a terrain of the vehicle, and storing characteristic information for each type of fuel. More particularly, the method includes creating a trip plan that optimizes performance of the vehicle in accordance with one or more operational criteria for the vehicle.

In another embodiment of the present invention, computer readable media containing program instructions are provided for a method for operating a vehicle. The vehicle includes an engine operating on at least one type of fuel. The method includes determining the location of the vehicle, providing information about a terrain of the vehicle, and storing characteristic information for each type of fuel. More particularly, the computer readable media includes a computer program code to create a trip plan that optimizes performance of the vehicle in accordance with one or more operational criteria for the vehicle.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
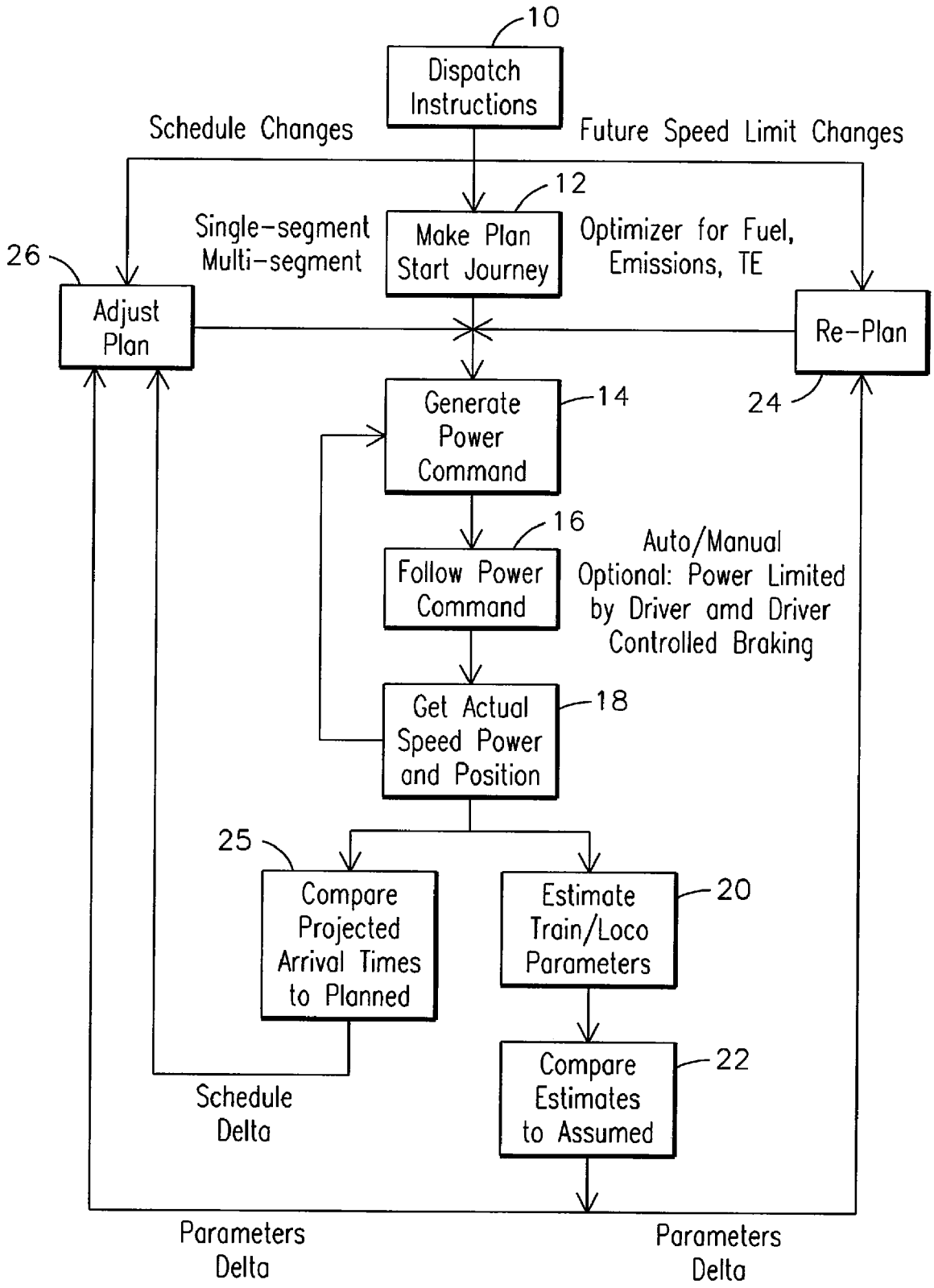
FIG. 1 depicts an exemplary illustration of a flow chart of one embodiment of the present invention.

Reference will now be made in detail to the embodiments consistent with the invention, examples of which are illustrated in the accompanying drawings. Wherever possible, the same reference numerals used throughout the drawings refer to the same or like parts.

The embodiments of the present invention solve the problems in the art by providing a system, method, and computer implemented method for determining and implementing a driving strategy of a train having a locomotive consist determining an approach to monitor and control a train's operations to improve certain objective operating criteria parameter requirements while satisfying schedule and speed constraints. The embodiments of the present invention are also operable when the locomotive consist is in distributed power operations. Persons skilled in the art will recognize that an apparatus, such as a data processing system, including a CPU, memory, I/O, program storage, a connecting bus, and other appropriate components, could be programmed or otherwise designed to facilitate the practice of the method embodiment of the invention. Such a system would include appropriate program means for executing the method embodiment of the invention.

Also, an article of manufacture, such as a pre-recorded disk or other similar computer program product, for use with a data processing system, could include a storage medium and program means recorded thereon for directing the data processing system to facilitate the practice of the method embodiment of the invention. Such apparatus and articles of manufacture also fall within the spirit and scope of the embodiments of the invention.

Broadly speaking, the embodiments of the invention provides a method, apparatus, and program for determining and implementing a driving strategy of a train having a locomotive consist determining an approach to monitor and control a train's operations to improve certain objective operating criteria parameter requirements while satisfying schedule and speed constraints. To facilitate an understanding of the embodiments of the present invention, it is described hereinafter with reference to specific implementations thereof. The embodiments of the invention are described in the general context of computer-executable instructions, such as program modules, being executed by a computer. Generally, program modules include routines, programs, objects, components, data structures, etc. that perform particular tasks or implement particular abstract data types. For example, the software programs that underlie the embodiments of the invention can be coded in different languages, for use with different platforms. In the description that follows, examples of embodiments of the invention are described in the context of a web portal that employs a web browser. It will be appreciated, however, that the principles that underlie the embodiments of the invention can be implemented with other types of computer software technologies as well.

Moreover, those skilled in the art will appreciate that the embodiments of the invention may be practiced with other computer system configurations, including hand-held devices, multiprocessor systems, microprocessor-based or programmable consumer electronics, minicomputers, mainframe computers, and the like. The embodiments of the invention may also be practiced in distributed computing environments where tasks are performed by remote processing devices that are linked through a communications network. In a distributed computing environment, program modules may be located in both local and remote computer storage media including memory storage devices. These local and remote computing environments may be contained entirely within the locomotive, or adjacent locomotives in consist, or off-board in wayside or central offices where wireless communication is used.

Throughout this document the term locomotive consist is used. As used herein, a locomotive consist may be described as having one or more locomotives in succession, connected together so as to provide motoring and/or braking capability. The locomotives are connected together where no train cars are in between the locomotives. The train can have more than one consist in its composition. Specifically, there can be a lead consist, and more than one remote consists, such as midway in the line of cars and another remote consist at the end of the train. Each locomotive consist may have a first locomotive and trail locomotive(s). Though a consist is usually viewed as successive locomotives, those skilled in the art will readily recognize that a consist group of locomotives may also be recognized as a consist even when at least a car separates the locomotives, such as when the consist is configured for distributed power operation, wherein throttle and braking commands are relayed from the lead locomotive to the remote trails by a radio link or physical cable. Towards this end, the term locomotive consist should be not be considered a limiting factor when discussing multiple locomotives within the same train.

Referring now to the drawings, embodiments of the present invention will be described. The embodiments of the invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the invention are discussed below.

FIG. 1 depicts an exemplary illustration of a flow chart of an embodiment of the present invention. As illustrated, instructions are input specific to planning a trip either on board or from a remote location, such as a dispatch center 10. Such input information includes, but is not limited to, train position, consist description (such as locomotive models), locomotive power description, performance of locomotive traction transmission, consumption of engine fuel as a function of output power, cooling characteristics, the intended trip route (effective track grade and curvature as function of mile-post or an "effective grade" component to reflect curvature following standard railroad practices), the train represented by car makeup and loading together with effective drag coefficients, trip desired parameters including, but not limited to, start time and location, end location, desired travel time, crew (user and/or operator) identification, crew shift expiration time, and route.

This data may be provided to the locomotive 42 in a number of ways, such as, but not limited to, an operator manually entering this data into the locomotive 42 via an onboard display, inserting a memory device such as a hard card and/or USB drive containing the data into a receptacle aboard the locomotive, and transmitting the information via wireless communication from a central or wayside location 41, such as a track signaling device and/or a wayside device, to the locomotive 42. Locomotive 42 and train 31 load characteristics (e.g., drag) may also change over the route (e.g., with altitude, ambient temperature and condition of the rails and rail-cars), and the plan may be updated to reflect such changes as needed by any of the methods discussed above and/or by real-time autonomous collection of locomotive/train conditions. This includes for example, changes in locomotive or train characteristics detected by monitoring equipment on or off board the locomotive(s) 42.

The track signal system determines the allowable speed of the train. There are many types of track signal systems and the operating rules associated with each of the signals. For example, some signals have a single light (on/off), some signals have a single lens with multiple colors, and some signals have multiple lights and colors. These signals can indicate the track is clear and the train may proceed at max allowable speed. They can also indicate a reduced speed or stop is required. This reduced speed may need to be achieved immediately, or at a certain location (e.g. prior to the next signal or crossing).

The signal status is communicated to the train and/or operator through various means. Some systems have circuits in the track and inductive pick-up coils on the locomotives. Other systems have wireless communications systems. Signal systems can also require the operator to visually inspect the signal and take the appropriate actions.

The signaling system may interface with the on-board signal system and adjust the locomotive speed according to the inputs and the appropriate operating rules. For signal systems that require the operator to visually inspect the signal status, the operator screen will present the appropriate signal options for the operator to enter based on the train's location. The type of signal systems and operating rules, as a function of location, may be stored in an onboard database 63.

Based on the specification data input into an embodiment of the present invention, an optimal plan which minimizes fuel use and/or emissions produced subject to speed limit constraints along the route with desired start and end times is computed to produce a trip profile 12. The profile contains the optimal speed and power (notch) settings the train is to follow, expressed as a function of distance and/or time, and such train operating limits, including but not limited to, the maximum notch power and brake settings, and speed limits as a function of location, and the expected fuel used and emissions generated. In an exemplary embodiment, the value for the notch setting is selected to obtain throttle change decisions about once every 10 to 30 seconds. Those skilled in the art will readily recognize that the throttle change decisions may occur at a longer or shorter duration, if needed and/or desired to follow an optimal speed profile. In a broader sense, it should be evident to ones skilled in the art the profiles provides power settings for the train, either at the train level, consist level and/or individual train level. Power comprises braking power, motoring power, and airbrake power. In another preferred embodiment, instead of operating at the traditional discrete notch power settings, the embodiment of the present invention is able to select a continuous power setting determined as optimal for the profile selected. Thus, for example, if an optimal profile specifies a notch setting of 6.8, instead of operating at notch setting 7, the locomotive 42 can operate at 6.8. Allowing such intermediate power settings may bring additional efficiency benefits as described below.

The procedure used to compute the optimal profile can be any number of methods for computing a power sequence that drives the train 31 to minimize fuel and/or emissions subject to locomotive operating and schedule constraints, as summarized below. In some cases the required optimal profile may be close enough to one previously determined, owing to the similarity of the train configuration, route and environmental conditions. In these cases it may be sufficient to look up the driving trajectory within a database 63 and attempt to follow it. When no previously computed plan is suitable, methods to compute a new one include, but are not limited to, direct calculation of the optimal profile using differential equation models which approximate the train physics of motion. The setup involves selection of a quantitative objective function, commonly a weighted sum (integral) of model variables that correspond to rate of fuel consumption and emissions generation plus a term to penalize excessive throttle variation.

An optimal control formulation is set up to minimize the quantitative objective function subject to constraints including but not limited to, speed limits and minimum and maximum power (throttle) settings. Depending on planning objectives at any time, the problem may be setup flexibly to minimize fuel subject to constraints on emissions and speed limits, or to minimize emissions, subject to constraints on fuel use and arrival time. It is also possible to setup, for example, a goal to minimize the total travel time without constraints on total emissions or fuel use where such relaxation of constraints would be permitted or required for the mission.

Throughout the document exemplary equations and objective functions are presented for minimizing locomotive fuel consumption. These equations and functions are for illustration only as other equations and objective functions can be employed to optimize fuel consumption or to optimize other locomotive/train operating parameters.

Mathematically, the problem to be solved may be stated more precisely. The basic physics are expressed by:

$$\frac{dx}{dt} = v;$$

$$x(0) = 0.0;$$

$$x(T_f) = D$$

$$\frac{dv}{dt} = T_e(u, v) - G_a(x) - R(v);$$

$$v(0) = 0.0;$$

$$v(T_f) = 0.0$$

Where x is the position of the train, v its velocity and t is time (in miles, miles per hour and minutes or hours as appropriate) and u is the notch (throttle) command input. Further, D denotes the distance to be traveled, $T_f$ the desired arrival time at distance D along the track, $T_e$ is the tractive effort produced by the locomotive consist, $G_a$ is the gravitational drag which depends on the train length, train makeup and terrain on which the train is located, R is the net speed dependent drag of the locomotive consist and train combination. The initial and final speeds can also be specified, but without loss of generality are taken to be zero here (train stopped at beginning and end). Finally, the model is readily modified to include other important dynamics such the lag between a change in throttle, u, and the resulting tractive effort or braking. Using this model, an optimal control formulation is set up to minimize the quantitative objective function subject to constraints including but not limited to, speed limits and minimum and maximum power (throttle) settings. Depending on planning objectives at any time, the problem may be setup flexibly to minimize fuel subject to constraints on emissions and speed limits, or to minimize emissions, subject to constraints on fuel use and arrival time.

It is also possible to setup, for example, a goal to minimize the total travel time without constraints on total emissions or fuel use where such relaxation of constraints would be permitted or required for the mission. All these performance measures can be expressed as a linear combination of any of the following:

$$1.\ \min_{u(t)} \int_0^{T_f} F(u(t))\,dt - \text{Minimize total fuel consumption}$$

$$2.\ \min_{u(t)} T_f - \text{Minimize Travel Time}$$

$$3.\ \min_{u_i} \sum_{i=2}^{n_d} (u_i - u_{i-1})^2 - \begin{array}{c}\text{Minimize notch jockeying}\\ \text{(piecewise constant input)}\end{array}$$

$$\min_{u(t)} \int_0^{T_f} (du/dt)^2\,dt - \begin{array}{c}\text{Minimize notch jockeying}\\ \text{(continuous input)}\end{array}$$

Replace the fuel term F in (1) with a term corresponding to emissions production. For example for emissions $$\min_{u(t)} \int_0^{T_f} E(u(t))\,dt$$

—Minimize total emissions consumption. In this equation E is the quantity of emissions in gm/hphr for each of the notches (or power settings). In addition a minimization could be done based on a weighted total of fuel and emissions.

A commonly used and representative objective function is thus $$\min_{u(t)} \alpha_1 \int_0^{T_f} F(u(t))\,dt + \alpha_3 T_f + \alpha_2 \int_0^{T_f} (du/dt)^2\,dt \qquad \text{(OP)}$$

The coefficients of the linear combination will depend on the importance (weight) given for each of the terms. When the vehicle operates on multiple fuel types, the fuel term F is a linear sum combination of the fuel efficiencies of each fuel type used by the vehicle, as discussed in further detail below. Note that in equation (OP), u(t) is the optimizing variable which is the continuous notch position. If discrete notch is required, e.g. for older locomotives, the solution to equation (OP) would be discretized, which may result in less fuel saving. Finding a minimum time solution ($\alpha_1$ and $\alpha_2$ set to zero) is used to find a lower bound on, the preferred embodiment is to solve the equation (OP) for various values of $T_f$ with $\alpha_3$ set to zero. For those familiar with solutions to such optimal problems, it may be necessary to adjoin constraints, e.g. the speed limits along the path:

$$0 \leqq v \leqq SL(x)$$

Or when using minimum time as the objective, that an end point constraint must hold, e.g. total fuel consumed must be less than what is in the tank, e.g. via:

$$0 < \int_0^{T_f} F(u(t))\,dt \leq W_F$$

Where $W_F$ is the fuel remaining in the tank at $T_f$. Those skilled in the art will readily recognize that equation (OP) can be in other forms as well and that what is presented above is an exemplary equation for use in the embodiment of the present invention.

Reference to emissions in the context of the exemplary embodiment of the present invention is actually directed towards cumulative emissions produced in the form of oxides of nitrogen (NOx), carbon oxides (COx), unburned hydrocarbons (HC), and particulate matter (PM), etc. However, other emissions may include, but not be limited to a maximum value of electromagnetic emission, such as a limit on radio frequency (RF) power output, measured in watts, for respective frequencies emitted by the locomotive. Yet another form of emission is the noise produced by the locomotive, typically measured in decibels (dB). An emission requirement may be variable based on a time of day, a time of year, and/or atmospheric conditions such as weather or pollutant level in the atmosphere. Emission regulations may vary geographically across a railroad system. For example, an operating area such as a city or state may have specified emission objectives, and an adjacent area may have different emission objectives, for example a lower amount of allowed emissions or a higher fee charged for a given level of emissions.

Accordingly, an emission profile for a certain geographic area may be tailored to include maximum emission values for each of the regulated emissions including in the profile to meet a predetermined emission objective required for that area. Typically, for a locomotive, these emission parameters are determined by, but not limited to, the power (Notch) setting, ambient conditions, engine control method, etc. By design, every locomotive must be compliant with EPA emission standards, and thus in an embodiment of the present invention that optimizes emissions this may refer to mission-total emissions, for which there is no current EPA specification. Operation of the locomotive according to the optimized trip plan is at all times compliant with EPA emission standards. Those skilled in the art will readily recognize that because diesel engines are used in other applications, other regulations may also be applicable. For example, CO2 emissions are considered in international treaties.

If a key objective during a trip mission is to reduce emissions, the optimal control formulation, equation (OP), would be amended to consider this trip objective. A key flexibility in the optimization setup is that any or all of the trip objectives can vary by geographic region or mission. For example, for a high priority train, minimum time may be the only objective on one route because it is high priority traffic. In another example emission output could vary from state to state along the planned train route.

To solve the resulting optimization problem, in an exemplary embodiment the present invention transcribes a dynamic optimal control problem in the time domain to an equivalent static mathematical programming problem with N decision variables, where the number 'N' depends on the frequency at which throttle and braking adjustments are made and the duration of the trip. For typical problems, this N can be in the thousands. For example in an exemplary embodiment, suppose a train is traveling a 172-mile stretch of track in the southwest United States. Utilizing one embodiment of the present invention, an exemplary 7.6% saving in fuel used may be realized when comparing a trip determined and followed using one embodiment of the present invention versus an actual driver throttle/speed history where the trip was determined by an operator. The improved savings is realized because the optimization realized by using the one embodiment of the present invention produces a driving strategy with both less drag loss and little or no braking loss compared to the trip plan of the operator.

Figure 2:
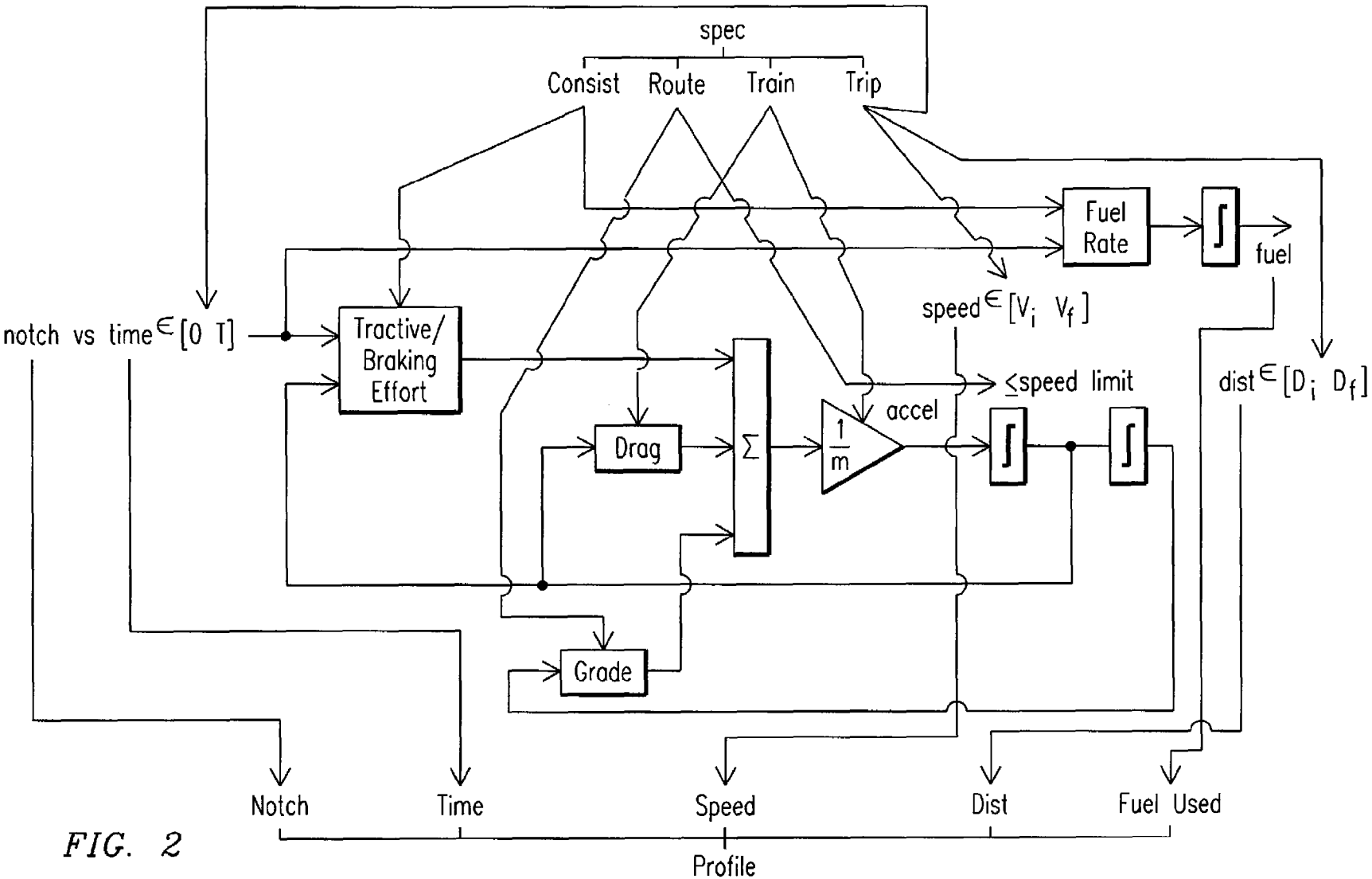
FIG. 2 depicts a simplified model of the train that may be employed.

To make the optimization described above computationally tractable, a simplified model of the train may be employed, such as illustrated in FIG. 2 and the equations discussed above. A key refinement to the optimal profile is produced by driving a more detailed model with the optimal power sequence generated, to test if other thermal, electrical and mechanical constraints are violated, leading to a modified profile with speed versus distance that is closest to a run that can be achieved without harming locomotive or train equipment, i.e. satisfying additional implied constraints such thermal and electrical limits on the locomotive and inter-car forces in the train.

Referring back to FIG. 1, once the trip is started 12, power commands are generated 14 to put the plan in motion. Depending on the operational set-up of one embodiment of the present invention, one command is for the locomotive to follow the optimized power command 16 so as to achieve the optimal speed. One embodiment of the present invention obtains actual speed and power information from the locomotive consist of the train 18. Owing to the inevitable approximations in the models used for the optimization, a closed-loop calculation of corrections to optimized power is obtained to track the desired optimal speed. Such corrections of train operating limits can be made automatically or by the operator, who always has ultimate control of the train.

In some cases, the model used in the optimization may differ significantly from the actual train. This can occur for many reasons, including but not limited to, extra cargo pick-ups or setouts, locomotives that fail in route, and errors in the initial database 63 or data entry by the operator. For these reasons a monitoring system is in place that uses real-time train data to estimate locomotive and/or train parameters in real time 20. The estimated parameters are then compared to the assumed parameters used when the trip was initially created 22. Based on any differences in the assumed and estimated values, the trip may be re-planned 24, should large enough savings accrue from a new plan.

Other reasons a trip may be re-planned include directives from a remote location, such as dispatch and/or the operator requesting a change in objectives to be consistent with more global movement planning objectives. More global movement planning objectives may include, but are not limited to, other train schedules, allowing exhaust to dissipate from a tunnel, maintenance operations, etc. Another reason may be due to an onboard failure of a component. Strategies for re-planning may be grouped into incremental and major adjustments depending on the severity of the disruption, as discussed in more detail below. In general, a "new" plan must be derived from a solution to the optimization problem equation (OP) described above, but frequently faster approximate solutions can be found, as described herein.

Figure 4:
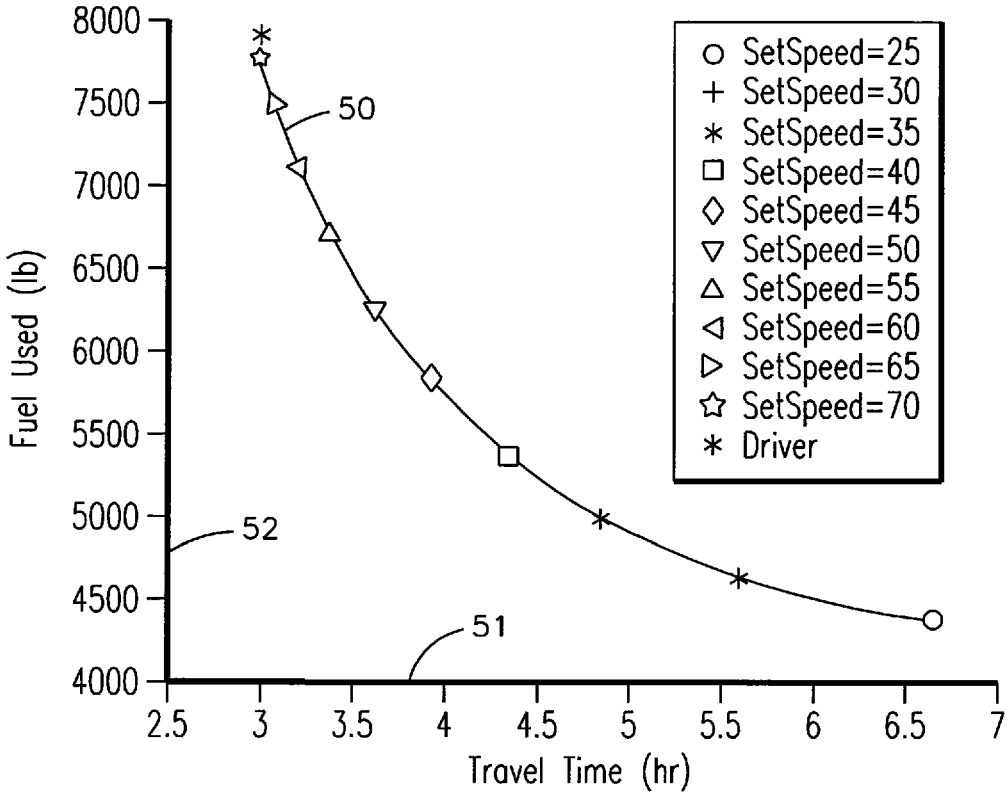
FIG. 4 depicts an exemplary embodiment of a fuel-use/travel time curve.

In operation, the locomotive 42 will continuously monitor system efficiency and continuously update the trip plan based on the actual efficiency measured, whenever such an update would improve trip performance. Re-planning computations may be carried out entirely within the locomotive(s) or fully or partially moved to a remote location, such as dispatch or wayside processing facilities where wireless technology is used to communicate the plans to the locomotive 42. One embodiment of the present invention may also generate efficiency trends that can be used to develop locomotive fleet data regarding efficiency transfer functions. The fleet-wide data may be used when determining the initial trip plan, and may be used for network-wide optimization tradeoff when considering locations of a plurality of trains. For example, the travel-time fuel use tradeoff curve as illustrated in FIG. 4 reflects a capability of a train on a particular route at a current time, updated from ensemble averages collected for many similar trains on the same route. Thus, a central dispatch facility collecting curves like FIG. 4 from many locomotives could use that information to better coordinate overall train movements to achieve a system-wide advantage in fuel use or throughput.

Many events in daily operations can lead to a need to generate or modify a currently executing plan, where it desired to keep the same trip objectives, for when a train is not on schedule for planned meet or pass with another train and it needs to make up time. Using the actual speed, power and location of the locomotive, a comparison is made between a planned arrival time and the currently estimated (predicted) arrival time 25. Based on a difference in the times, as well as the difference in parameters (detected or changed by dispatch or the operator), the plan is adjusted 26. This adjustment may be made automatically following a railroad company's desire for how such departures from plan should be handled or manually propose alternatives for the on-board operator and dispatcher to jointly decide the best way to get back on plan. Whenever a plan is updated but where the original objectives, such as but not limited to arrival time remain the same, additional changes may be factored in concurrently, e.g. new future speed limit changes, which could affect the feasibility of ever recovering the original plan. In such instances if the original trip plan cannot be maintained, or in other words the train is unable to meet the original trip plan objectives, as discussed herein other trip plan(s) may be presented to the operator and/or remote facility, or dispatch.

A re-plan may also be made when it is desired to change the original objectives. Such re-planning can be done at either fixed preplanned times, manually at the discretion of the operator or dispatcher, or autonomously when predefined limits, such a train operating limits, are exceeded. For example, if the current plan execution is running late by more than a specified threshold, such as thirty minutes, one embodiment of the present invention can re-plan the trip to accommodate the delay at expense of increased fuel as described above or to alert the operator and dispatcher how much of the time can be made up at all (i.e. what minimum time to go or the maximum fuel that can be saved within a time constraint). Other triggers for re-plan can also be envisioned based on fuel consumed or the health of the power consist, including but not limited time of arrival, loss of horsepower due to equipment failure and/or equipment temporary malfunction (such as operating too hot or too cold), and/or detection of gross setup errors, such in the assumed train load. That is, if the change reflects impairment in the locomotive performance for the current trip, these may be factored into the models and/or equations used in the optimization.

Changes in plan objectives can also arise from a need to coordinate events where the plan for one train compromises the ability of another train to meet objectives and arbitration at a different level, e.g. the dispatch office is required. For example, the coordination of meets and passes may be further optimized through train-to-train communications. Thus, as an example, if a train knows that it is behind in reaching a location for a meet and/or pass, communications from the other train can notify the late train (and/or dispatch). The operator can then enter information pertaining to being late into one embodiment of the present invention which will recalculate the train's trip plan. The embodiment of the present invention can also be used at a high level, or network-level, to allow a dispatch to determine which train should slow down or speed up should a scheduled meet and/or pass time constraint may not be met. As discussed herein, this is accomplished by trains transmitting data to the dispatch to prioritize how each train should change its planning objective. A choice could depend either from schedule or fuel saving benefits, depending on the situation.

For any of the manually or automatically initiated re-plans, the exemplary embodiment of the present invention may present more than one trip plan to the operator. In an exemplary embodiment the present invention will present different profiles to the operator, allowing the operator to select the arrival time and understand the corresponding fuel and/or emission impact. Such information can also be provided to the dispatch for similar consideration, either as a simple list of alternatives or as a plurality of tradeoff curves such as illustrated in FIG. 4.

The exemplary embodiment of the present invention has the ability of learning and adapting to key changes in the train and power consist which can be incorporated either in the current plan and/or for future plans. For example, one of the triggers discussed above is loss of horsepower. When building up horsepower over time, either after a loss of horsepower or when beginning a trip, transition logic is utilized to determine when desired horsepower is achieved. This information can be saved in the locomotive database 61 for use in optimizing either future trips or the current trip should loss of horsepower occur again.

Figure 3:
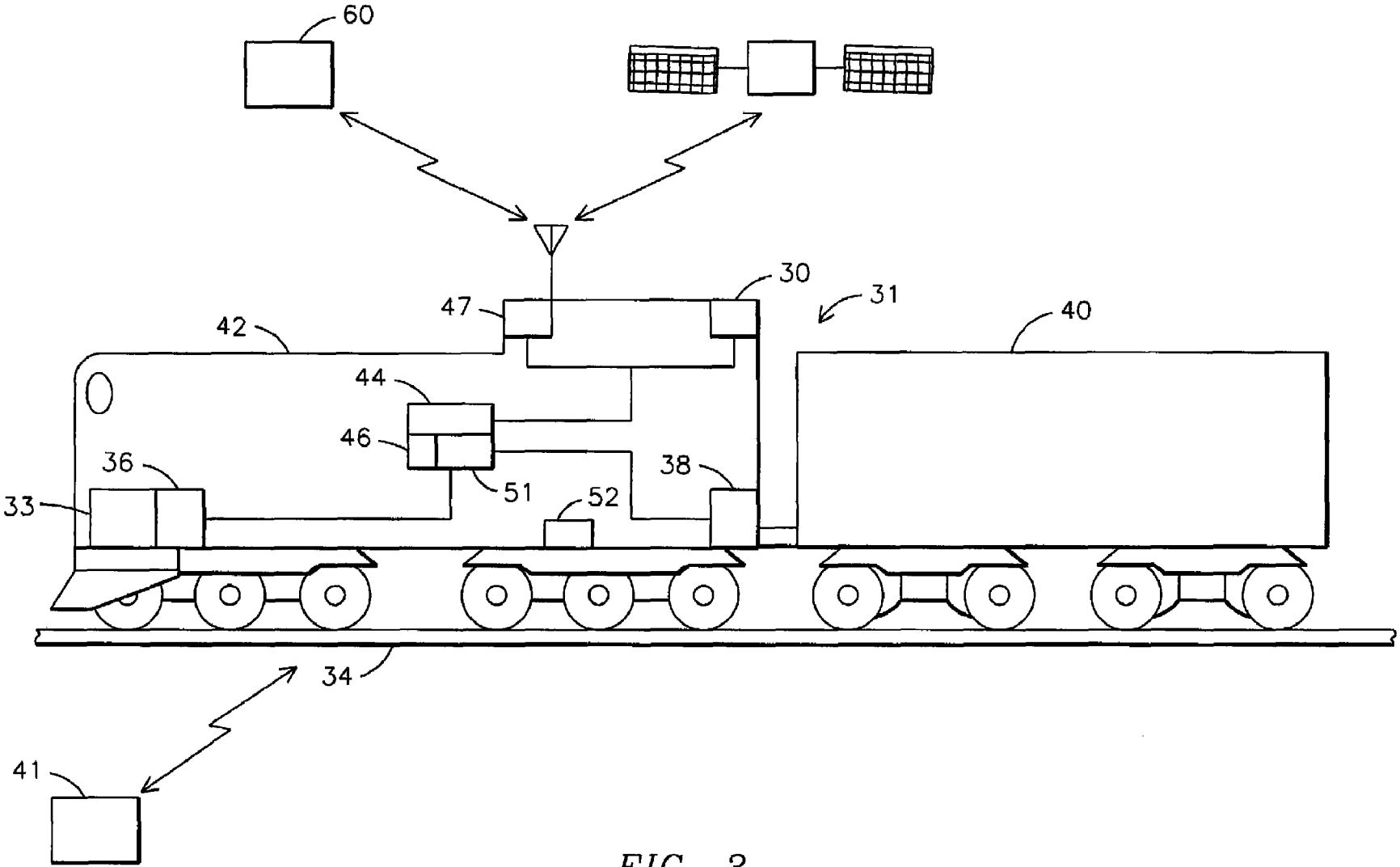
FIG. 3 depicts an exemplary embodiment of elements of the present invention.

FIG. 3 depicts an exemplary embodiment of elements of the present invention. A locator element 30 to determine a location of the train 31 is provided. The locator element 30 can be a GPS sensor, or a system of sensors, that determine a location of the train 31. Examples of such other systems may include, but are not limited to, wayside devices, such as radio frequency automatic equipment identification (RF AEI) Tags, dispatch, and/or video determination. Another system may include the tachometer(s) aboard a locomotive and distance calculations from a reference point. As discussed previously, a wireless communication system 47 may also be provided to allow for communications between trains and/or with a remote location, such as dispatch. Information about travel locations may also be transferred from other trains.

A track characterization element 33 to provide information about a track, principally grade and elevation and curvature information, is also provided. The track characterization element 33 may include an on-board track integrity database 36. Sensors 38 are used to measure a tractive effort 40 being hauled by the locomotive consist 42, throttle setting of the locomotive consist 42, locomotive consist 42 configuration information, speed of the locomotive consist 42, individual locomotive configuration, individual locomotive capability, etc. In an exemplary embodiment the locomotive consist 42 configuration information may be loaded without the use of a sensor 38, but is input by other approaches as discussed above. Furthermore, the health of the locomotives in the consist may also be considered. For example, if one locomotive in the consist is unable to operate above power notch level 5, this information is used when optimizing the trip plan.

Information from the locator element may also be used to determine an appropriate arrival time of the train 31. For example, if there is a train 31 moving along a track 34 towards a destination and no train is following behind it, and the train has no fixed arrival deadline to adhere to, the locator element, including but not limited to radio frequency automatic equipment identification (RF AEI) Tags, dispatch, and/or video determination, may be used to gage the exact location of the train 31. Furthermore, inputs from these signaling systems may be used to adjust the train speed. Using the on-board track database, discussed below, and the locator element, such as GPS, the embodiment of the present invention can adjust the operator interface to reflect the signaling system state at the given locomotive location. In a situation where signal states would indicate restrictive speeds ahead, the planner may elect to slow the train to conserve fuel consumption.

Information from the locator element 30 may also be used to change planning objectives as a function of distance to destination. For example, owing to inevitable uncertainties about congestion along the route, "faster" time objectives on the early part of a route may be employed as hedge against delays that statistically occur later. If it happens on a particular trip that delays do not occur, the objectives on a latter part of the journey can be modified to exploit the built-in slack time that was banked earlier, and thereby recover some fuel efficiency. A similar strategy could be invoked with respect to emissions restrictive objectives, e.g. approaching an urban area.

As an example of the hedging strategy, if a trip is planned from New York to Chicago, the system may have an option to operate the train slower at either the beginning of the trip or at the middle of the trip or at the end of the trip. The embodiment of the present invention would optimize the trip plan to allow for slower operation at the end of the trip since unknown constraints, such as but not limited to weather conditions, track maintenance, etc., may develop and become known during the trip. As another consideration, if traditionally congested areas are known, the plan is developed with an option to have more flexibility around these traditionally congested regions. Therefore, the embodiment of the present invention may also consider weighting/penalty as a function of time/distance into the future and/or based on known/past experience. Those skilled in the art will readily recognize that such planning and re-planning to take into consideration weather conditions, track conditions, other trains on the track, etc., may be taking into consideration at any time during the trip wherein the trip plan is adjust accordingly.

FIG. 3 further discloses other elements that may be part of the embodiment of the present invention. A processor 44 is provided that is operable to receive information from the locator element 30, track characterizing element 33, and sensors 38. An algorithm 46 operates within the processor 44. The algorithm 46 is used to compute an optimized trip plan based on parameters involving the locomotive 42, train 31, track 34, and objectives of the mission as described above. In an exemplary embodiment, the trip plan is established based on models for train behavior as the train 31 moves along the track 34 as a solution of non-linear differential equations derived from physics with simplifying assumptions that are provided in the algorithm. The algorithm 46 has access to the information from the locator element 30, track characterizing element 33 and/or sensors 38 to create a trip plan minimizing fuel consumption of a locomotive consist 42, minimizing emissions of a locomotive consist 42, establishing a desired trip time, and/or ensuring proper crew operating time aboard the locomotive consist 42. In an exemplary embodiment, a driver, or controller element, 51 is also provided. As discussed herein the controller element 51 is used for controlling the train as it follows the trip plan. In an exemplary embodiment discussed further herein, the controller element 51 makes train operating decisions autonomously. In another exemplary embodiment the operator may be involved with directing the train to follow the trip plan.

A requirement of the embodiment of the present invention is the ability to initially create and quickly modify on the fly any plan that is being executed. This includes creating the initial plan when a long distance is involved, owing to the complexity of the plan optimization algorithm. When a total length of a trip profile exceeds a given distance, an algorithm 46 may be used to segment the mission wherein the mission may be divided by waypoints. Though only a single algorithm 46 is discussed, those skilled in the art will readily recognize that more than one algorithm may be used where the algorithms may be connected together. The waypoint may include natural locations where the train 31 stops, such as, but not limited to, sidings where a meet with opposing traffic, or pass with a train behind the current train is scheduled to occur on single-track rail, or at yard sidings or industry where cars are to be picked up and set out, and locations of planned work. At such waypoints, the train 31 may be required to be at the location at a scheduled time and be stopped or moving with speed in a specified range. The time duration from arrival to departure at waypoints is called dwell time.

In an exemplary embodiment, the embodiment of the present invention is able to break down a longer trip into smaller segments in a special systematic way. Each segment can be somewhat arbitrary in length, but is typically picked at a natural location such as a stop or significant speed restriction, or at key mileposts that define junctions with other routes. Given a partition, or segment, selected in this way, a driving profile is created for each segment of track as a function of travel time taken as an independent variable, such as shown in FIG. 4. The fuel used/travel-time tradeoff associated with each segment can be computed prior to the train 31 reaching that segment of track. A total trip plan can be created from the driving profiles created for each segment. The example of the invention distributes travel time amongst all the segments of the trip in an optimal way so that the total trip time required is satisfied and total fuel consumed over all the segments is as small as possible. An exemplary segment trip 3 is disclosed in FIG. 6 and discussed below. Those skilled in the art will recognize however, through segments are discussed, the trip plan may comprise a single segment representing the complete trip.

FIG. 4 depicts an exemplary embodiment of a fuel-use/travel time curve. As mentioned previously, such a curve 50 is created when calculating an optimal trip profile for various travel times for each segment. That is, for a given travel time 51, fuel used 52 is the result of a detailed driving profile computed as described above. Once travel times for each segment are allocated, a power/speed plan is determined for each segment from the previously computed solutions. If there are any waypoint constraints on speed between the segments, such as, but not limited to, a change in a speed limit, they are matched up during creation of the optimal trip profile. If speed restrictions change in only a single segment, the fuel use/travel-time curve 50 has to be re-computed for only the segment changed. This reduces time for having to recalculate more parts, or segments, of the trip. If the locomotive consist or train changes significantly along the route, e.g. from loss of a locomotive or pickup or set-out of cars, then driving profiles for all subsequent segments must be recomputed creating new instances of the curve 50. These new curves 50 would then be used along with new schedule objectives to plan the remaining trip.

Once a trip plan is created as discussed above, a trajectory of speed and power versus distance is used to reach a destination with minimum fuel and/or emissions at the required trip time. There are several ways in which to execute the trip plan. As provided below in more detail, in one exemplary embodiment, a coaching mode the embodiment of the present invention displays information to the operator for the operator to follow to achieve the required power and speed determined according to the optimal trip plan. In this mode, the operating information is suggested operating conditions that the operator should use. In another exemplary embodiment, acceleration and maintaining a constant speed are performed by the embodiment of the present invention. However, when the train 31 must be slowed, the operator is responsible for applying a braking system 52. In another exemplary embodiment, the present invention commands power and braking as required to follow the desired speed-distance path.

Feedback control strategies are used to provide corrections to the power control sequence in the profile to correct for such events as, but not limited to, train load variations caused by fluctuating head winds and/or tail winds. Another such error may be caused by an error in train parameters, such as, but not limited to, train mass and/or drag, when compared to assumptions in the optimized trip plan. A third type of error may occur with information contained in the track database 36. Another possible error may involve un-modeled performance differences due to the locomotive engine, traction motor thermal duration and/or other factors. Feedback control strategies compare the actual speed as a function of position to the speed in the desired optimal profile. Based on this difference, a correction to the optimal power profile is added to drive the actual velocity toward the optimal profile. To assure stable regulation, a compensation algorithm may be provided which filters the feedback speeds into power corrections to assure closed-performance stability is assured. Compensation may include standard dynamic compensation as used by those skilled in the art of control system design to meet performance objectives.

The embodiment of the present invention allows the simplest and therefore fastest means to accommodate changes in trip objectives, which is the rule, rather than the exception in railroad operations. In an exemplary embodiment to determine the fuel-optimal trip from point A to point B where there are stops along the way, and for updating the trip for the remainder of the trip once the trip has begun, a sub-optimal decomposition method is usable for finding an optimal trip profile. Using modeling methods the computation method can find the trip plan with specified travel time and initial and final speeds, so as to satisfy all the speed limits and locomotive capability constraints when there are stops. Though the following discussion is directed towards optimizing fuel use, it can also be applied to optimize other factors, such as, but not limited to, emissions, schedule, crew comfort, and load impact. The method may be used at the outset in developing a trip plan, and more importantly to adapting to changes in objectives after initiating a trip.

Figure 5:
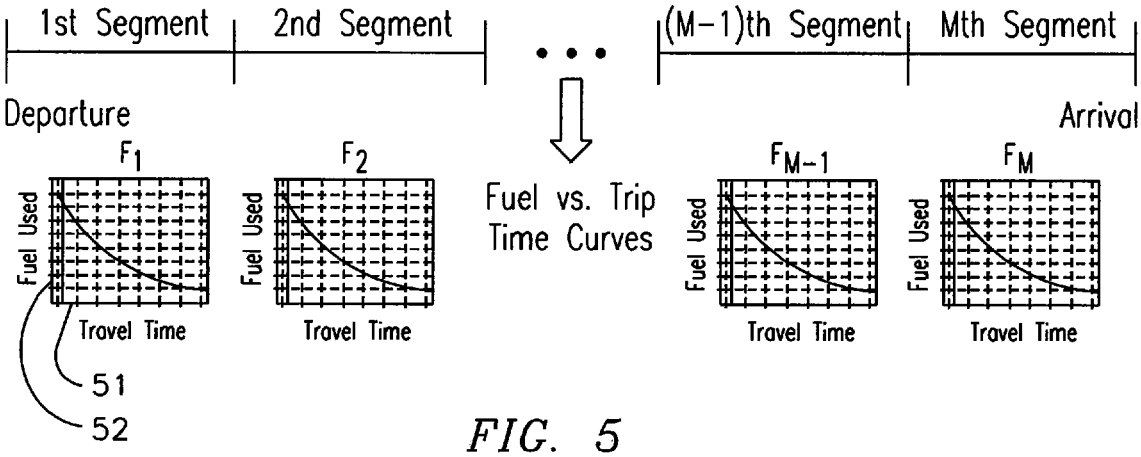
FIG. 5 depicts an exemplary embodiment of segmentation decomposition for trip planning.
Figure 6:
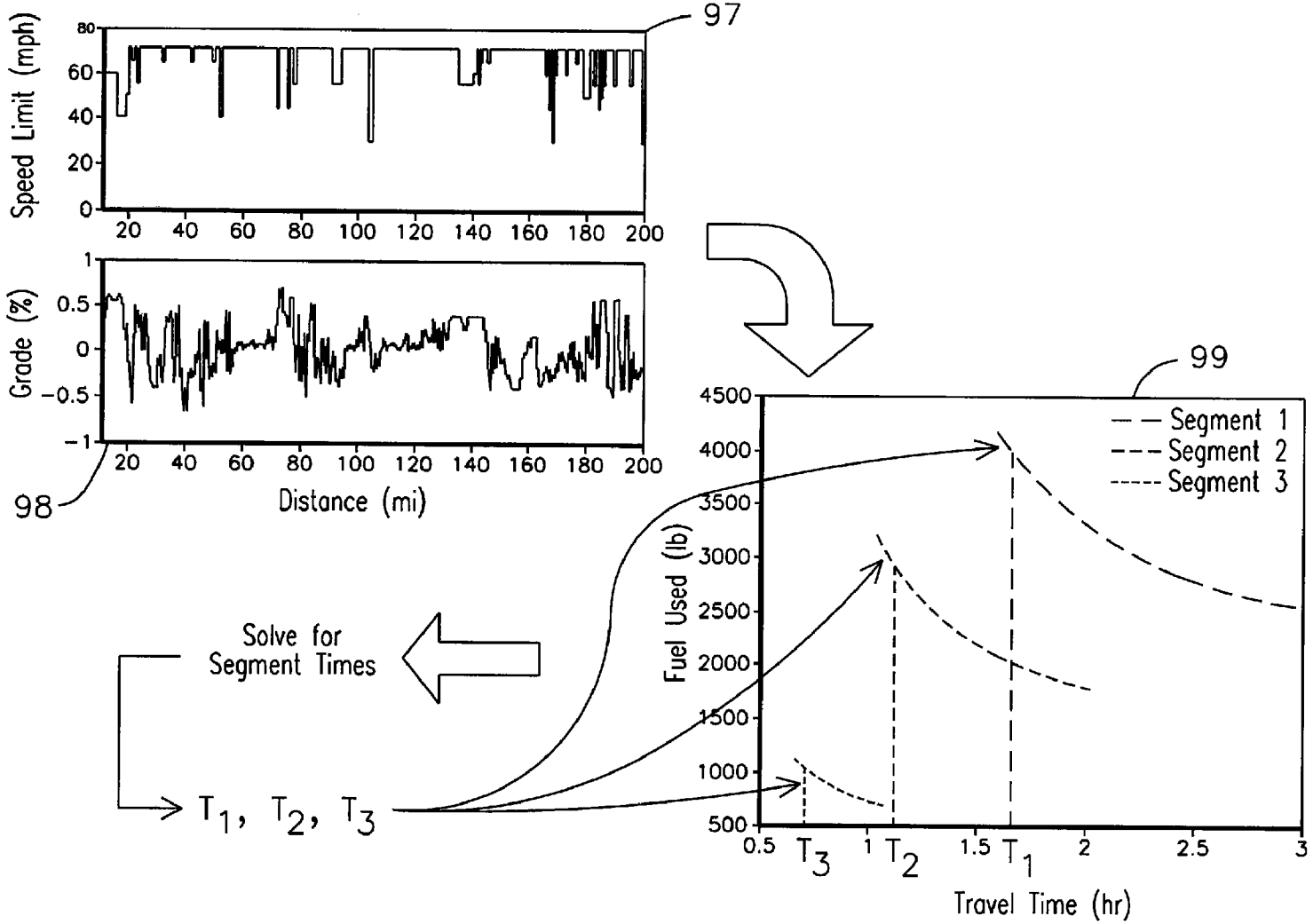
FIG. 6 depicts an exemplary embodiment of a segmentation example.

As discussed herein, the exemplary embodiment of the present invention may employ a setup as illustrated in the exemplary flow chart depicted in FIG. 5, and as an exemplary segment 3 example depicted in detail in FIG. 6. As illustrated, the trip may be broken into two or more segments, T1, T2, and T3. Though as discussed herein, it is possible to consider the trip as a single segment. As discussed herein, the segment boundaries may not result in equal segments. Instead the segments use natural or mission specific boundaries. Optimal trip plans are pre-computed for each segment. If fuel use versus trip time is the trip object to be met, fuel versus trip time curves are built for each segment. As discussed herein, the curves may be based on other factors, wherein the factors are objectives to be met with a trip plan. When trip time is the parameter being determined, trip time for each segment is computed while satisfying the overall trip time constraints. FIG. 6 illustrates speed limits for an exemplary segment 3 200 mile trip 97. Further illustrated are grade changes over the 200 mile trip 98. A combined chart 99 illustrating curves for each segment of the trip of fuel used over the travel time is also shown.

Using the optimal control setup described previously, the present computation method can find the trip plan with specified travel time and initial and final speeds, so as to satisfy all the speed limits and locomotive capability constraints when there are stops. Though the following detailed discussion is directed towards optimizing fuel use, it can also be applied to optimize other factors as discussed herein, such as, but not limited to, emissions. A key flexibility is to accommodate desired dwell time at stops and to consider constraints on earliest arrival and departure at a location as may be required, for example, in single-track operations where the time to be in or get by a siding is critical.

The embodiment of the present invention finds a fuel-optimal trip from distance $D_0$ to $D_M$, traveled in time T, with M−1 intermediate stops at $D_1, \ldots, D_{M-1}$, and with the arrival and departure times at these stops constrained by $$t_{min}(i) \leqq t_{arr}(D_i) \leqq t_{max}(i) - \Delta t_i$$

$$t_{arr}(D_i) + \Delta t_i \leqq t_{dep}(D_i) \leqq t_{max}(i) \quad i = 1, \ldots, M-1$$

where $t_{arr}(D_i)$, $t_{dep}(D_i)$, and $\Delta t_i$ are the arrival, departure, and minimum stop time at the $i^{th}$ stop, respectively. Assuming that fuel-optimality implies minimizing stop time, therefore $t_{dep}(D_i) = t_{arr}(D_i) + \Delta t_i$ which eliminates the second inequality above. Suppose for each i=1, . . . , M, the fuel-optimal trip from $D_{i-1}$, to $D_i$ for travel time t, $T_{min}(i) \leqq t \leqq T_{max}(i)$, is known. Let $F_i(t)$ be the fuel-use corresponding to this trip. If the travel time from $D_{j-1}$ to $D_j$ is denoted $T_j$, then the arrival time at $D_i$ is given by $$t_{arr}(D_i) = \sum_{j=1}^{i} (T_j + \Delta t_{j-1})$$

where $\Delta t_0$ is defined to be zero. The fuel-optimal trip from $D_0$ to $D_M$ for travel time T is then obtained by finding $T_i$, i=1, . . . , M, which minimize $$\sum_{i=1}^{M} F_i(T_i) \quad T_{\min}(i) \leq T_i \leq T_{\max}(i)$$

subject to $$t_{\min}(i) \leq \sum_{j=1}^{i} (T_j + \Delta t_{j-1}) \leq t_{\max}(i) - \Delta t_i$$

$$i = 1, \ldots, M-1$$

$$\sum_{j=1}^{M} (T_j + \Delta t_{j-1}) = T$$

Once a trip is underway, the issue is re-determining the fuel-optimal solution for the remainder of a trip (originally from $D_0$ to $D_M$ in time T) as the trip is traveled, but where disturbances preclude following the fuel-optimal solution. Let the current distance and speed be x and v, respectively, where $D_{i-1}<x\leqq D_i$. Also, let the current time since the beginning of the trip be tact. Then the fuel-optimal solution for the remainder of the trip from x to $D_M$, which retains the original arrival time at $D_M$, is obtained by finding $\tilde{T}_i$, $T_j$, j=i+1, . . . M, which minimize $$\tilde{F}_i(\tilde{T}_i, x, v) + \sum_{j=i+1}^{M} F_j(T_j)$$

subject to $$t_{\min}(i) \le t_{act} + \tilde{T}_i \le t_{\max}(i) - \Delta t_i$$

$$t_{\min}(k) \le t_{act} + \tilde{T}_i + \sum_{j=i+1}^{k} (T_j + \Delta t_{j-1}) \le t_{\max}(k) - \Delta t_k$$

$$k = i+1, \ldots, M-1$$

$$t_{act} + \tilde{T}_i + \sum_{j=i+1}^{M} (T_j + \Delta t_{j-1}) = T$$

Here, $\tilde{F}_i(t,x,v)$ is the fuel-used of the optimal trip from x to $D_i$, traveled in time t, with initial speed at x of v.

As discussed above, an exemplary way to enable more efficient re-planning is to construct the optimal solution for a stop-to-stop trip from partitioned segments. For the trip from $D_{i-1}$ to $D_i$, with travel time $T_i$, choose a set of intermediate points $D_{ij}$, j=1, . . . , $N_i$−1. Let $D_{i0}=D_{i-1}$ and $D_{iN_i}=D_i$. Then express the fuel-use for the optimal trip from $D_{i-1}$ to $D_i$ as $$F_i(t) = \sum_{j=1}^{N_i} f_{ij}(t_{ij} - t_{i,j-1}, v_{i,j-1}, v_{ij})$$

where $f_{ij}(t, v_{i,j-1}, v_{ij})$ is the fuel-use for the optimal trip from $D_{i,j-1}$ to $D_{ij}$, traveled in time t, with initial and final speeds of $v_{i,j-1}$ and $v_{ij}$. Furthermore, $t_{ij}$ is the time in the optimal trip corresponding to distance $D_{ij}$. By definition, $t_{iN_i}-t_{i0}=T_i$. Since the train is stopped at $D_{i0}$ and $D_{iN_i}$, $v_{i0}=v_{iN_i}=0$.

The above expression enables the function $F_i(t)$ to be alternatively determined by first determining the functions $f_{ij}(\bullet)$, $1\leqq j\leqq N_i$, then finding $\tau_{ij}$, $1\leqq j\leqq N_i$ and $v_{ij}$, $1\leqq j\leqq N_i$, which minimize $$F_i(t) = \sum_{j=1}^{N_i} f_{ij}(\tau_{ij}, v_{i,j-1}, v_{ij})$$

subject to $$\sum_{j=1}^{N_i} \tau_{ij} = T_i$$

$$v_{\min}(i, j) \le v_{ij} \le v_{\max}(i, j)$$

$$j = 1, \ldots, N_i - 1$$

$$v_{i0} = v_{iN_i} = 0$$

By choosing $D_{ij}$ (e.g., at speed restrictions or meeting points), $v_{max}(i,j)-v_{min}(i,j)$ can be minimized, thus minimizing the domain over which $f_{ij}(\ )$ needs to be known.

Based on the partitioning above, a simpler suboptimal re-planning approach than that described above is to restrict re-planning to times when the train is at distance points $D_{ij}$, $1\leqq i\leqq M$, $1\leqq j\leqq N_i$. At point $D_{ij}$, the new optimal trip from $D_{ij}$ to $D_M$ can be determined by finding $\tau_{ik}$, $j<k\leqq N_i$, $v_{ik}$, $j<k<N_i$, and $\tau_{mn}$, $i<m\leqq M$, $1\leqq n\leqq N_m$, $v_{mn}$, $i<m\leqq M$, $1\leqq n<N_m$, which minimize $$\sum_{k=j+1}^{N_i} f_{ik}(\tau_{ik}, v_{i,k-1}, v_{ik}) + \sum_{m=i+1}^{M} \sum_{n=1}^{N_{in}} f_{mn}(\tau_{mn}, v_{m,n-1}, v_{mn})$$

subject to $$t_{\min}(i) \le t_{act} + \sum_{k=j+1}^{N_i} \tau_{ik} \le t_{\max}(i) - \Delta t_i$$

$$t_{\min}(n) \le t_{act} + \sum_{k=j+1}^{N_i} \tau_{ik} + \sum_{m=i+1}^{n} (T_m + \Delta t_{m-1}) \le t_{\max}(n) - \Delta t_n$$

$$n = i+1, \ldots, M-1$$

$$t_{act} + \sum_{k=j+1}^{N_i} \tau_{ik} + \sum_{m=i+1}^{M} (T_m + \Delta t_{m-1}) = T$$

where $$T_m = \sum_{n=1}^{N_m} \tau_{mn}$$

A further simplification is obtained by waiting on the re-computation of $T_m$, $i<m\leqq M$, until distance point $D_i$ is reached. In this way, at points $D_{ij}$ between $D_{i-1}$ and $D_i$, the minimization above needs only be performed over $\tau_{ik}$, $j<k\leqq N_i$, $v_{ik}$, $j<k<N_i$. $T_i$ is increased as needed to accommodate any longer actual travel time from $D_{i-1}$ to $D_{ij}$ than planned. This increase is later compensated, if possible, by the re-computation of $T_m$, $i<m\leqq M$, at distance point $D_i$.

With respect to the closed-loop configuration disclosed above, the total input energy required to move a train 31 from point A to point B consists of the sum of four components, specifically difference in kinetic energy between points A and B; difference in potential energy between points A and B; energy loss due to friction and other drag losses; and energy dissipated by the application of brakes. Assuming the start and end speeds to be equal (e.g., stationary), the first component is zero. Furthermore, the second component is independent of driving strategy. Thus, it suffices to minimize the sum of the last two components.

Following a constant speed profile minimizes drag loss. Following a constant speed profile also minimizes total energy input when braking is not needed to maintain constant speed. However, if braking is required to maintain constant speed, applying braking just to maintain constant speed will most likely increase total required energy because of the need to replenish the energy dissipated by the brakes. A possibility exists that some braking may actually reduce total energy usage if the additional brake loss is more than offset by the resultant decrease in drag loss caused by braking, by reducing speed variation.

After completing a re-plan from the collection of events described above, the new optimal notch/speed plan can be followed using the closed loop control described herein. However, in some situations there may not be enough time to carry out the segment decomposed planning described above, and particularly when there are critical speed restrictions that must be respected, an alternative is needed. The embodiment of the present invention accomplishes this with an algorithm referred to as "smart cruise control". The smart cruise control algorithm is an efficient way to generate, on the fly, an energy-efficient (hence fuel-efficient) sub-optimal prescription for driving the train 31 over a known terrain. This algorithm assumes knowledge of the position of the train 31 along the track 34 at all times, as well as knowledge of the grade and curvature of the track versus position. The method relies on a point-mass model for the motion of the train 31, whose parameters may be adaptively estimated from online measurements of train motion as described earlier.

The smart cruise control algorithm has three principal components, specifically a modified speed limit profile that serves as an energy-efficient guide around speed limit reductions; an ideal throttle or dynamic brake setting profile that attempts to balance between minimizing speed variation and braking; and a mechanism for combining the latter two components to produce a notch command, employing a speed feedback loop to compensate for mismatches of modeled parameters when compared to reality parameters. Smart cruise control can accommodate strategies in the embodiment of the present invention that do no active braking (i.e. the driver is signaled and assumed to provide the requisite braking) or a variant that does active braking.

With respect to the cruise control algorithm that does not control dynamic braking, the three exemplary components are a modified speed limit profile that serves as an energy-efficient guide around speed limit reductions, a notification signal directed to notify the operator when braking should be applied, an ideal throttle profile that attempts to balance between minimizing speed variations and notifying the operator to apply braking, a mechanism employing a feedback loop to compensate for mismatches of model parameters to reality parameters.

Also included in the embodiment of the present invention is an approach to identify key parameter values of the train 31. For example, with respect to estimating train mass, a Kalman filter and a recursive least-squares approach may be utilized to detect errors that may develop over time.

Figure 7:
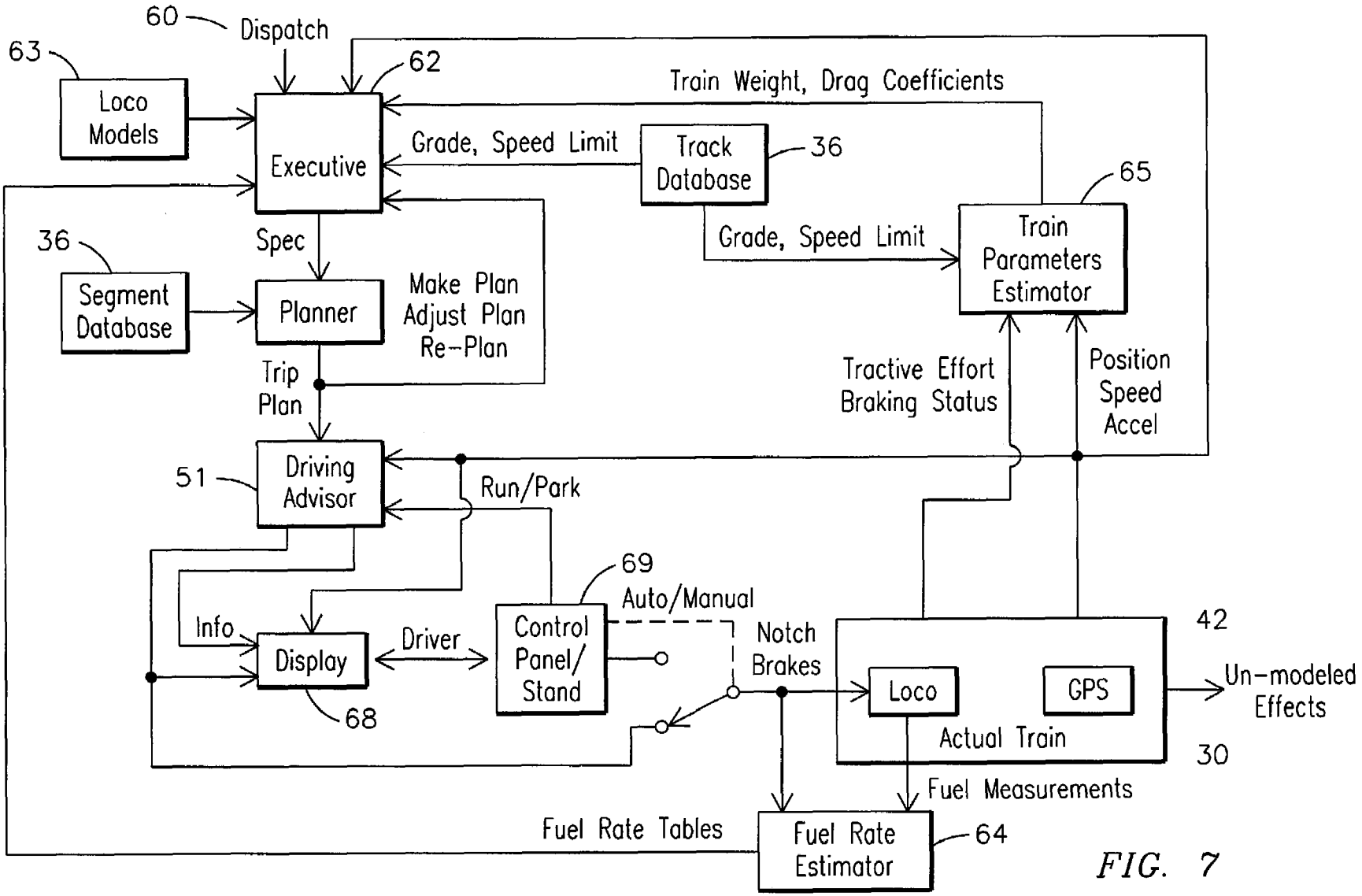
FIG. 7 depicts an exemplary flow chart of one embodiment of the present invention.

FIG. 7 depicts an exemplary flow chart of the embodiment of the present invention. As discussed previously, a remote facility, such as a dispatch 60 can provide information to the embodiment of the present invention. As illustrated, such information is provided to an executive control element 62. Also supplied to the executive control element 62 is locomotive modeling information database 63, information from a track database 36 such as, but not limited to, track grade information and speed limit information, estimated train parameters such as, but not limited to, train weight and drag coefficients, and fuel rate tables from a fuel rate estimator 64. The executive control element 62 supplies information to the planner 12, which is disclosed in more detail in FIG. 1. Once a trip plan has been calculated, the plan is supplied to a driving advisor, driver or controller element 51. The trip plan is also supplied to the executive control element 62 so that it can compare the trip when other new data is provided.

As discussed above, the driving advisor 51 can automatically set a notch power, either a pre-established notch setting or an optimum continuous notch power. In addition to supplying a speed command to the locomotive 31, a display 68 is provided so that the operator can view what the planner has recommended. The operator also has access to a control panel 69. Through the control panel 69 the operator can decide whether to apply the notch power recommended. Towards this end, the operator may limit a targeted or recommended power. That is, at any time the operator always has final authority over what power setting the locomotive consist will operate at. This includes deciding whether to apply braking if the trip plan recommends slowing the train 31. For example, if operating in dark territory, or where information from wayside equipment cannot electronically transmit information to a train and instead the operator views visual signals from the wayside equipment, the operator inputs commands based on information contained in track database and visual signals from the wayside equipment. Based on how the train 31 is functioning, information regarding fuel measurement is supplied to the fuel rate estimator 64. Since direct measurement of fuel flows is not typically available in a locomotive consist, all information on fuel consumed so far within a trip and projections into the future following optimal plans is carried out using calibrated physics models such as those used in developing the optimal plans. For example, such predictions may include but are not limited to, the use of measured gross horse-power and known fuel characteristics to derive the cumulative fuel used.

The train 31 also has a locator device 30 such as a GPS sensor, as discussed above. Information is supplied to the train parameters estimator 65. Such information may include, but is not limited to, GPS sensor data, tractive/braking effort data, braking status data, speed and any changes in speed data. With information regarding grade and speed limit information, train weight and drag coefficients information is supplied to the executive control element 62.

The exemplary embodiment of the present invention may also allow for the use of continuously variable power throughout the optimization planning and closed loop control implementation. In a conventional locomotive, power is typically quantized to eight discrete levels. Modern locomotives can realize continuous variation in horsepower which may be incorporated into the previously described optimization methods. With continuous power, the locomotive 42 can further optimize operating conditions, e.g., by minimizing auxiliary loads and power transmission losses, and fine tuning engine horsepower regions of optimum efficiency, or to points of increased emissions margins. Example include, but are not limited to, minimizing cooling system losses, adjusting alternator voltages, adjusting engine speeds, and reducing number of powered axles. Further, the locomotive 42 may use the on-board track database 36 and the forecasted performance requirements to minimize auxiliary loads and power transmission losses to provide optimum efficiency for the target fuel consumption/emissions. Examples include, but are not limited to, reducing a number of powered axles on flat terrain and pre-cooling the locomotive engine prior to entering a tunnel.

The exemplary embodiment of the present invention may also use the on-board track database 36 and the forecasted performance to adjust the locomotive performance, such as to insure that the train has sufficient speed as it approaches a hill and/or tunnel. For example, this could be expressed as a speed constraint at a particular location that becomes part of the optimal plan generation created solving the equation (OP). Additionally, the embodiment of the present invention may incorporate train-handling rules, such as, but not limited to, tractive effort ramp rates, maximum braking effort ramp rates. These may incorporated directly into the formulation for optimum trip profile or alternatively incorporated into the closed loop regulator used to control power application to achieve the target speed.

In a preferred embodiment of the present invention, such an embodiment is only installed on a lead locomotive of the train consist. Even though the embodiment of the present invention is not dependant on data or interactions with other locomotives, it may be integrated with a consist manager, as disclosed in U.S. Pat. No. 6,691,957 and patent application Ser. No. 10/429,596 (owned by the Assignee and both incorporated by reference), functionality and/or a consist optimizer functionality to improve efficiency. Interaction with multiple trains is not precluded as illustrated by the example of dispatch arbitrating two "independently optimized" trains described herein.

Trains with distributed power systems can be operated in different modes. One mode is where all locomotives in the train operate at the same notch command. So if the lead locomotive is commanding motoring—N8, all units in the train will be commanded to generate motoring—N8 power. Another mode of operation is "independent" control. In this mode, locomotives or sets of locomotives distributed throughout the train can be operated at different motoring or braking powers. For example, as a train crests a mountaintop, the lead locomotives (on the down slope of mountain) may be placed in braking, while the locomotives in the middle or at the end of the train (on the up slope of mountain) may be in motoring. This is done to minimize tensile forces on the mechanical couplers that connect the railcars and locomotives. Traditionally, operating the distributed power system in "independent" mode required the operator to manually command each remote locomotive or set of locomotives via a display in the lead locomotive. Using the physics based planning model, train set-up information, on-board track database, on-board operating rules, location determination system, real-time closed loop power/brake control, and sensor feedback, the system shall automatically operate the distributed power system in "independent" mode.

When operating in distributed power, the operator in a lead locomotive can control operating functions of remote locomotives in the remote consists via a control system, such as a distributed power control element. Thus when operating in distributed power, the operator can command each locomotive consist to operate at a different notch power level (or one consist could be in motoring and other could be in braking) wherein each individual locomotive in the locomotive consist operates at the same notch power. In an exemplary embodiment, with the embodiment of the present invention installed on the train, preferably in communication with the distributed power control element, when a notch power level for a remote locomotive consist is desired as recommended by the optimized trip plan, the embodiment of the present invention will communicate this power setting to the remote locomotive consists for implementation. As discussed below, the same is true regarding braking.

The exemplary embodiment of the present invention may be used with consists in which the locomotives are not contiguous, e.g., with 1 or more locomotives up front, others in the middle and at the rear for train. Such configurations are called distributed power wherein the standard connection between the locomotives is replaced by radio link or auxiliary cable to link the locomotives externally. When operating in distributed power, the operator in a lead locomotive can control operating functions of remote locomotives in the consist via a control system, such as a distributed power control element. In particular, when operating in distributed power, the operator can command each locomotive consist to operate at a different notch power level (or one consist could be in motoring and other could be in braking) wherein each individual in the locomotive consist operates at the same notch power.

In an exemplary embodiment of the present invention installed on the train, preferably in communication with the distributed power control element, when a notch power level for a remote locomotive consist is desired as recommended by the optimized trip plan, the embodiment of the present invention will communicate this power setting to the remote locomotive consists for implementation. As discussed below, the same is true regarding braking. When operating with distributed power, the optimization problem previously described can be enhanced to allow additional degrees of freedom, in that each of the remote units can be independently controlled from the lead unit. The value of this is that additional objectives or constraints relating to in-train forces may be incorporated into the performance function, assuming the model to reflect the in-train forces is also included. Thus, the embodiment of the present invention may include the use of multiple throttle controls to better manage in-train forces as well as fuel consumption and emissions.

In a train utilizing a consist manager, the lead locomotive in a locomotive consist may operate at a different notch power setting than other locomotives in that consist. The other locomotives in the consist operate at the same notch power setting. The embodiment of the present invention may be utilized in conjunction with the consist manager to command notch power settings for the locomotives in the consist. Thus, based on the embodiment of the present invention, since the consist manager divides a locomotive consist into two groups, lead locomotive and trail units, the lead locomotive will be commanded to operate at a certain notch power and the trail locomotives are commanded to operate at another certain notch power. In an exemplary embodiment the distributed power control element may be the system and/or apparatus where this operation is housed.

Likewise, when a consist optimizer is used with a locomotive consist, the embodiment of the present invention can be used in conjunction with the consist optimizer to determine notch power for each locomotive in the locomotive consist. For example, suppose that a trip plan recommends a notch power setting of 4 for the locomotive consist. Based on the location of the train, the consist optimizer will take this information and then determine the notch power setting for each locomotive in the consist In this implementation, the efficiency of setting notch power settings over intra-train communication channels is improved. Furthermore, as discussed above, implementation of this configuration may be performed utilizing the distributed control system.

Furthermore, as discussed previously, the embodiment of the present invention may be used for continuous corrections and re-planning with respect to when the train consist uses braking based on upcoming items of interest, such as but not limited to railroad crossings, grade changes, approaching sidings, approaching depot yards, and approaching fuel stations where each locomotive in the consist may require a different braking option. For example, if the train is coming over a hill, the lead locomotive may have to enter a braking condition whereas the remote locomotives, having not reached the peak of the hill may have to remain in a motoring state.

Figure 8:
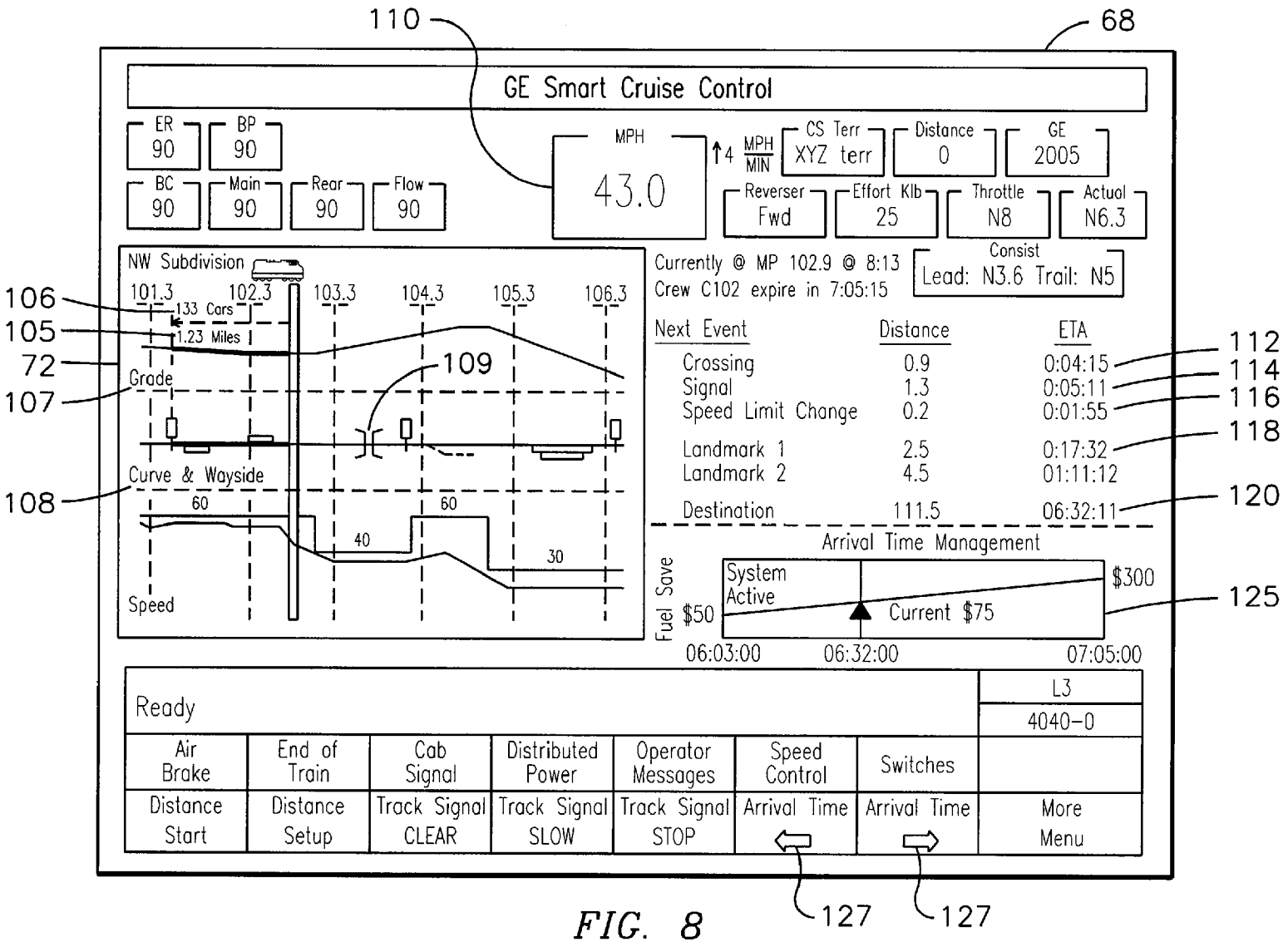
FIG. 8 depicts an exemplary illustration of a dynamic display for use by the operator.
Figure 9:
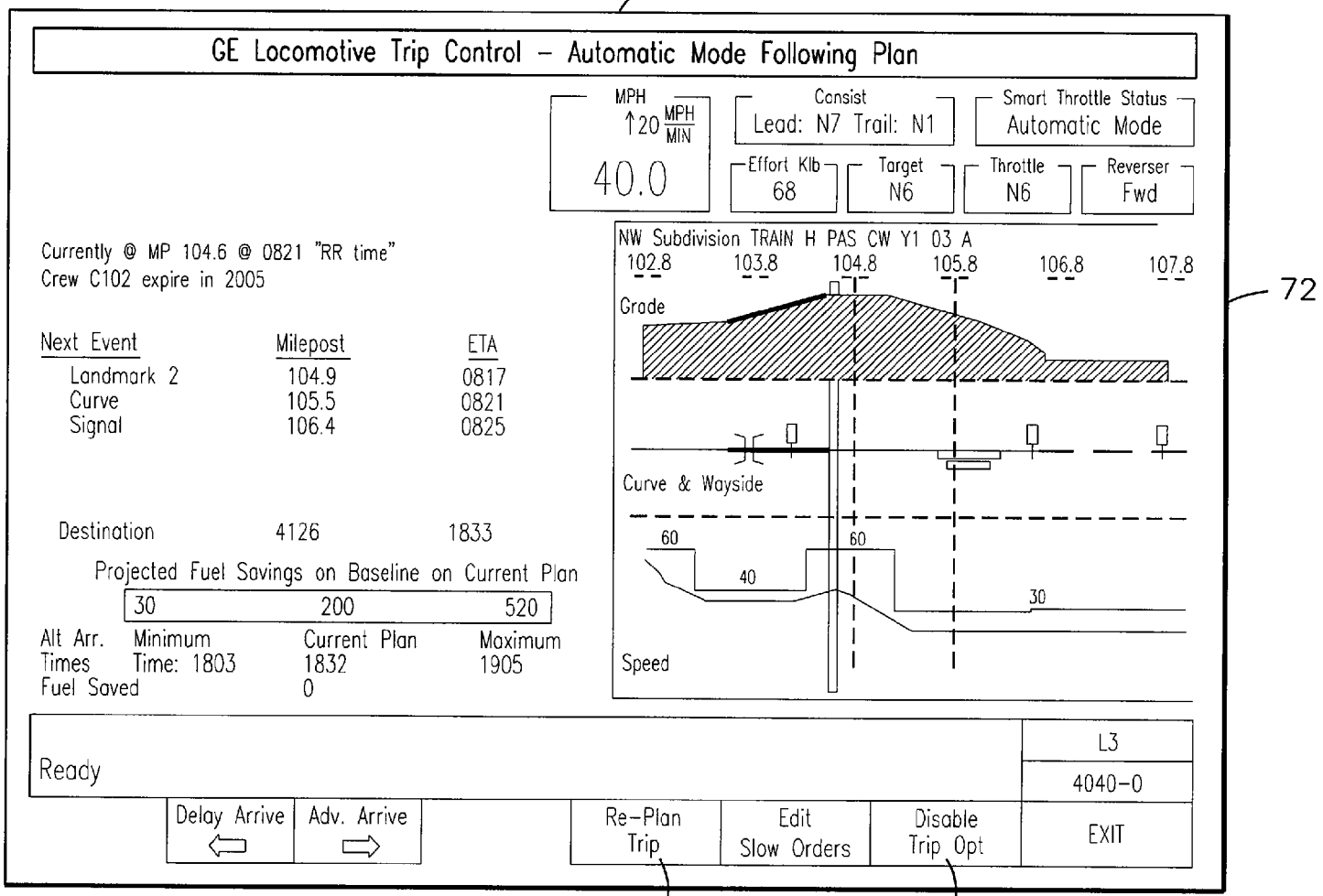
FIG. 9 depicts another exemplary illustration of a dynamic display for use by the operator.
Figure 10:
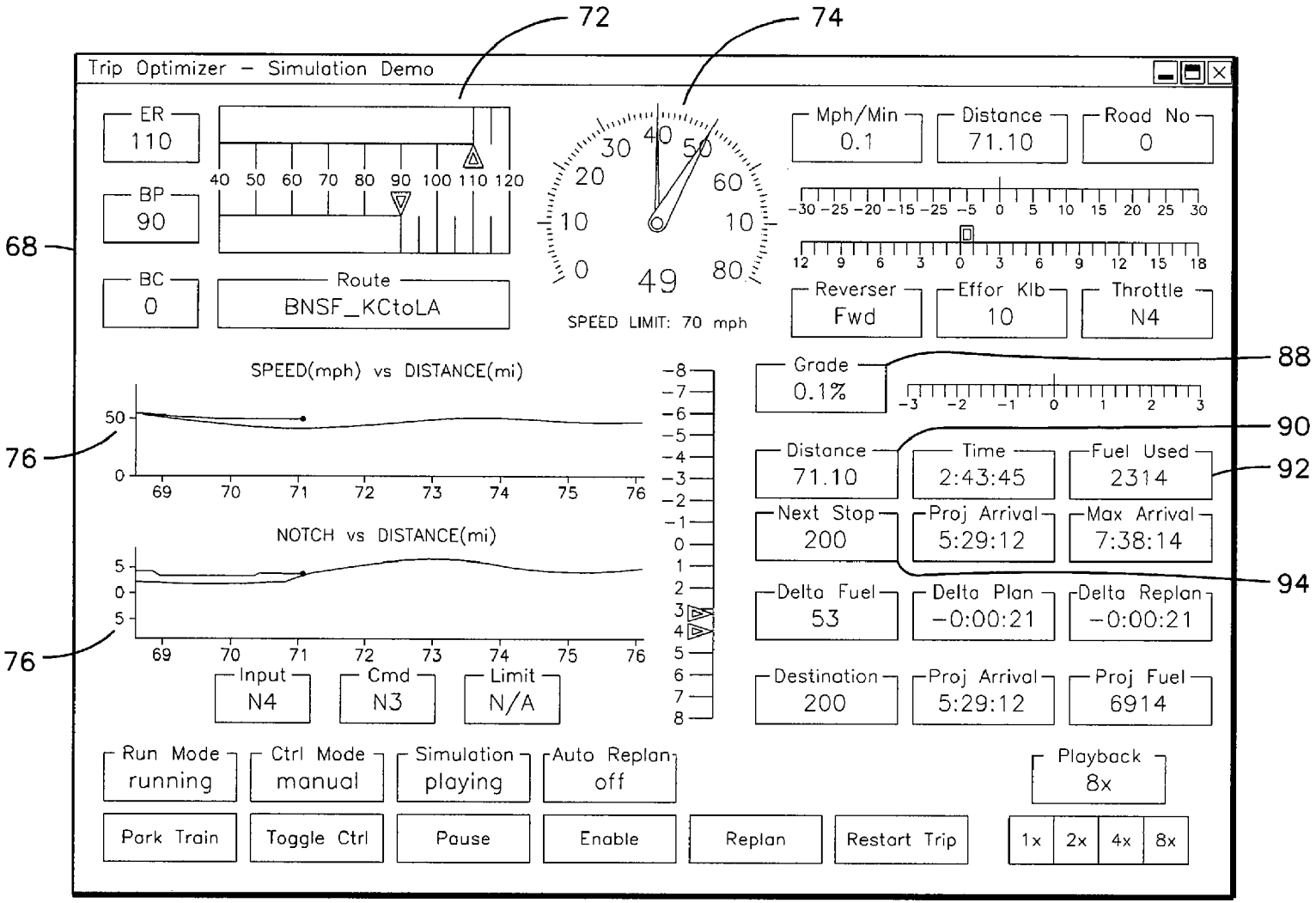
FIG. 10 depicts another exemplary illustration of a dynamic display for use by the operator.

FIGS. 8, 9 and 10 depict exemplary illustrations of dynamic displays for use by the operator. As provided, FIG. 8, a trip profile is provided 72. Within the profile a location 73 of the locomotive is provided. Such information as train length 105 and the number of cars 106 in the train is provided. Elements are also provided regarding track grade 107, curve and wayside elements 108, including bridge location 109, and train speed 110. The display 68 allows the operator to view such information and also see where the train is along the route. Information pertaining to distance and/or estimate time of arrival to such locations as crossings 112, signals 114, speed changes 116, landmarks 118, and destinations 120 is provided. An arrival time management tool 125 is also provided to allow the user to determine the fuel savings that is being realized during the trip. The operator has the ability to vary arrival times 127 and witness how this affects the fuel savings. As discussed herein, those skilled in the art will recognize that fuel saving is an exemplary example of only one objective that can be reviewed with a management tool. Towards this end, depending on the parameter being viewed, other parameters, discussed herein can be viewed and evaluated with a management tool that is visible to the operator. The operator is also provided information about how long the crew has been operating the train. In exemplary embodiments time and distance information may either be illustrated as the time and/or distance until a particular event and/or location or it may provide a total elapsed time.

As illustrated in FIG. 9 an exemplary display provides information about consist data 130, an events and situation graphic 132, an arrival time management tool 134, and action keys 136. Similar information as discussed above is provided in this display as well. This display 68 also provides action keys 138 to allow the operator to re-plan as well as to disengage 140 the embodiment of the present invention.

FIG. 10 depicts another exemplary embodiment of the display. Data typical of a modern locomotive including airbrake status 72, analog speedometer with digital inset 74, and information about tractive effort in pounds force (or traction amps for DC locomotives) is visible. An indicator 74 is provided to show the current optimal speed in the plan being executed as well as an accelerometer graphic to supplement the readout in mph/minute. Important new data for optimal plan execution is in the center of the screen, including a rolling strip graphic 76 with optimal speed and notch setting versus distance compared to the current history of these variables. In this exemplary embodiment, location of the train is derived using the locator element. As illustrated, the location is provided by identifying how far the train is away from its final destination, an absolute position, an initial destination, an intermediate point, and/or an operator input.

The strip chart provides a look-ahead to changes in speed required to follow the optimal plan, which is useful in manual control, and monitors plan versus actual during automatic control. As discussed herein, such as when in the coaching mode, the operator can either follow the notch or speed suggested by the embodiment of the present invention. The vertical bar gives a graphic of desired and actual notch, which are also displayed digitally below the strip chart. When continuous notch power is utilized, as discussed above, the display will simply round to closest discrete equivalent, the display may be an analog display so that an analog equivalent or a percentage or actual horse power/tractive effort is displayed.

Critical information on trip status is displayed on the screen, and shows the current grade the train is encountering 88, either by the lead locomotive, a location elsewhere along the train or an average over the train length. A distance traveled so far in the plan 90, cumulative fuel used 92, where or the distance away the next stop is planned 94, current and projected arrival time 96 expected time to be at next stop are also disclosed. The display 68 also shows the maximum possible time to destination possible with the computed plans available. If a later arrival was required, a re-plan would be carried out. Delta plan data shows status for fuel and schedule ahead or behind the current optimal plan. Negative numbers mean less fuel or early compared to plan, positive numbers mean more fuel or late compared to plan, and typically tradeoff in opposite directions (slowing down to save fuel makes the train late and conversely).

At all times these displays 68 gives the operator a snapshot of where he stands with respect to the currently instituted driving plan. This display is for illustrative purpose only as there are many other ways of displaying/conveying this information to the operator and/or dispatch. Towards this end, the information disclosed above could be intermixed to provide a display different than the ones disclosed.

Other features that may be included in the embodiment of the present invention include, but are not limited to, allowing for the generating of data logs and reports. This information may be stored on the train and downloaded to an off-board system at some point in time. The downloads may occur via manual and/or wireless transmission. This information may also be viewable by the operator via the locomotive display. The data may include such information as, but not limited to, operator inputs, time system is operational, fuel saved, fuel imbalance across locomotives in the train, train journey off course, system diagnostic issues such as if GPS sensor is malfunctioning.

Since trip plans must also take into consideration allowable crew operation time, the embodiment of the present invention may take such information into consideration as a trip is planned. For example, if the maximum time a crew may operate is eight hours, then the trip shall be fashioned to include stopping location for a new crew to take the place of the present crew. Such specified stopping locations may include, but are not limited to rail yards, meet/pass locations, etc. If, as the trip progresses, the trip time may be exceeded, the embodiment of the present invention may be overridden by the operator to meet criteria as determined by the operator. Ultimately, regardless of the operating conditions of the train, such as but not limited to high load, low speed, train stretch conditions, etc., the operator remains in control to command a speed and/or operating condition of the train.

Using the embodiment of the present invention, the train may operate in a plurality of operations. In one operational concept, the embodiment of the present invention may provide commands for commanding propulsion, dynamic braking. The operator then handles all other train functions. In another operational concept, the embodiment of the present invention may provide commands for commanding propulsion only. The operator then handles dynamic braking and all other train functions. In yet another operational concept, the embodiment of the present invention may provide commands for commanding propulsion, dynamic braking and application of the airbrake. The operator then handles all other train functions.

Though exemplary embodiments of the present invention are described with respect to rail vehicles, specifically trains and locomotives having diesel engines, exemplary embodiments of the invention are also applicable for other uses, such as but not limited to off-highway vehicles, marine vessels, and stationary units, each which may use a diesel engine. Towards this end, when discussing a specified mission, this includes a task or requirement to be performed by the diesel powered system. Therefore, with respect to railway, marine or off-highway vehicle applications this may refer to the movement of the system from a present location to a destination. In the case of stationary applications, such as but not limited to a stationary power generating station or network of power generating stations, a specified mission may refer to an amount of wattage (e.g., MW/hr) or other parameter or requirement to be satisfied by the diesel powered system. Likewise, operating condition of the diesel-fueled power generating unit may include one or more of speed, load, fueling value, timing, etc.

In one exemplary example involving marine vessels, a plurality of tugs may be operating together where all are moving the same larger vessel, where each tug is linked in time to accomplish the mission of moving the larger vessel. In another exemplary example a single marine vessel may have a plurality of engines. Off Highway Vehicle (OHV) may involve a fleet of vehicles that have a same mission to move on earth, from location A to location B, where each OHV is linked in time to accomplish the mission.

The embodiment of the present invention may also be used to notify the operator of upcoming items of interest of actions to be taken. Specifically, the forecasting logic of the embodiment of the present invention, the continuous corrections and re-planning to the optimized trip plan, the track database, the operator can be notified of upcoming crossings, signals, grade changes, brake actions, sidings, rail yards, fuel stations, etc. This notification may occur audibly and/or through the operator interface.

Specifically using the physics based planning model, train set-up information, on-board track database, on-board operating rules, location determination system, real-time closed loop power/brake control, and sensor feedback, the system shall present and/or notify the operator of required actions. The notification can be visual and/or audible. Examples include notifying of crossings that require the operator activate the locomotive horn and/or bell, notifying of "silent" crossings that do not require the operator activate the locomotive horn or bell.

In another exemplary embodiment, using the physics based planning model discussed above, train set-up information, on-board track database, on-board operating rules, location determination system, real-time closed power/brake control, and sensor feedback, the embodiment of the present invention may present the operator information (e.g. a gauge on display) that allows the operator to see when the train will arrive at various locations as illustrated in FIG. 9. The system shall allow the operator to adjust the trip plan (target arrival time). This information (actual estimated arrival time or information needed to derive off-board) can also be communicated to the dispatch center to allow the dispatcher or dispatch system to adjust the target arrival times. This allows the system to quickly adjust and optimize for the appropriate target function (for example trading off speed and fuel usage).

Figure 11:
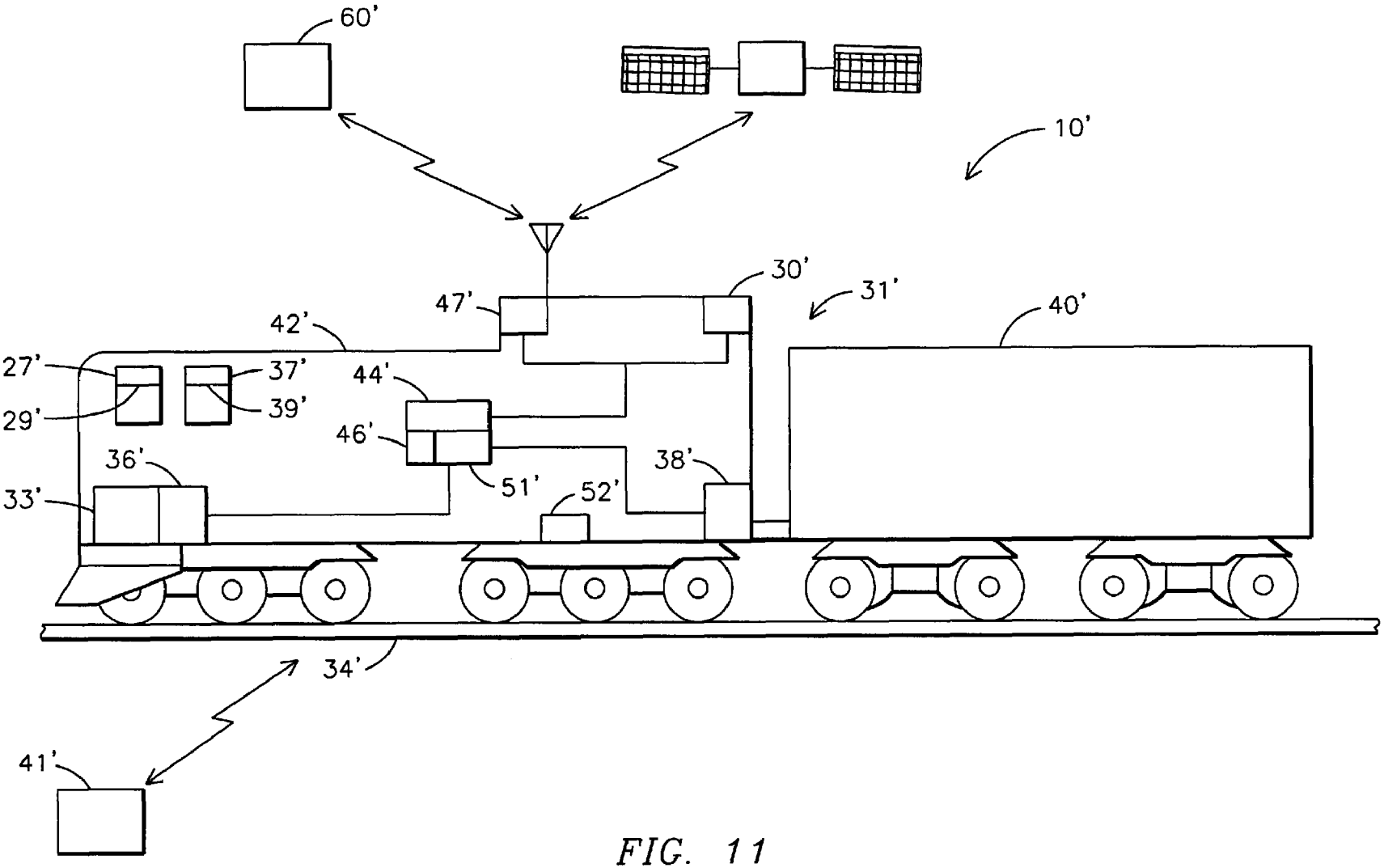
FIG. 11 depicts an exemplary embodiment of elements of the present invention.

FIG. 11 illustrates another embodiment of the present invention including a system 10' for operating a vehicle 31'. The vehicle may include a train 31' with one or more locomotive consists 42', as illustrated in FIG. 11, an off-highway vehicle (OHV), a marine vehicle, or any similar vehicle including an engine operating on a plurality of fuel types. The plurality of fuel types include one or more diesel based fuels and one or more alternate fuels. More particularly, each alternate fuel may include one of biodiesel, palm oil, and rape seed oil. Accordingly, although FIGS. 11-14 illustrate the system 10' for operating a train 31' with one or more locomotive consists 42', the system may be similarly applied to OHV's and marine vehicles.

Though exemplary embodiments of the present invention are described with respect to rail vehicles, specifically trains and locomotives having diesel engines, exemplary embodiments of the invention are also applicable for other uses, such as but not limited to off-highway vehicles, marine vessels, and stationary units, each which may use a diesel engine. Towards this end, when discussing a specified mission, this includes a task or requirement to be performed by the diesel powered system. Therefore, with respect to railway, marine or off-highway vehicle applications this may refer to the movement of the system from a present location to a destination. In the case of stationary applications, such as but not limited to a stationary power generating station or network of power generating stations, a specified mission may refer to an amount of wattage (e.g., MW/hr) or other parameter or requirement to be satisfied by the diesel powered system. Likewise, operating condition of the diesel-fueled power generating unit may include one or more of speed, load, fueling value, timing, etc.

In one exemplary example involving marine vessels, a plurality of tugs may be operating together where all are moving the same larger vessel, where each tug is linked in time to accomplish the mission of moving the larger vessel. In another exemplary example a single marine vessel may have a plurality of engines. Off Highway Vehicle (OHV) may involve a fleet of vehicles that have a same mission to move earth, from location A to location B, where each OHV is linked in time to accomplish the mission.

The system includes a locator element 30' to determine a location of the locomotive consist 42'. The locator element 30' can be a GPS sensor, or a system of sensors, that determine a location of the train 31'. Examples of such other systems may include, but are not limited to, wayside devices, such as radio frequency automatic equipment identification (RF AEI) tags, dispatch, and/or video determination. Another system may include the tachometer(s) aboard a locomotive and distance calculations from a reference point. A wireless communication system 47' may also be provided to allow for communications between trains and/or with a remote location, such as dispatch. Information about travel locations may also be transferred from other trains.

The system 10' further includes a characterization element 33' to provide information about a terrain 34' (ie. track) of the locomotive consist 42'. The track characterization element 33' may include an on-board track integrity database 36'. Sensors 38' are used to measure a tractive effort 40' being hauled by the locomotive consist 42', throttle setting of the locomotive consist 42', locomotive consist 42' configuration information, speed of the locomotive consist 42', individual locomotive configuration, individual locomotive capability, etc. In an exemplary embodiment the locomotive consist 42' configuration information may be loaded without the use of a sensor 38', in which case the configuration information may be loaded by an input device. The input device may be coupled with the processor 44' to transfer the characteristic information of each fuel type among the plurality of fuel types to the processor, including at least one of fuel efficiency, emission characteristics, respective tank volume, cost availability, and location availability. The input device may provide the characteristic information of each of the plurality of fuel types by one of a remote location, a roadside device, and a user through manual input. In addition to the characteristic information of each of the plurality of fuel types, the health of the locomotives in the consist may also be considered. For example, if one locomotive in the consist is unable to operate above power notch level 5 (when using a specific type of fuel), this information is used when optimizing the trip plan.

Information from the locator element 30' may also be used to determine an appropriate arrival time of the train 31'. For example, if there is a train 31' moving along a track 34' towards a destination and no train is following behind it, and the train has no fixed arrival deadline to adhere to, the locator element 30', including but not limited to radio frequency automatic equipment identification (RF AEI) Tags, dispatch, and/or video determination, may be used to gage the exact location of the train 31'. Furthermore, inputs from these signaling systems may be used to adjust the train speed. Using the on-board track database, discussed below, and the locator element, such as GPS, the embodiment of the present invention can adjust the operator interface to reflect the signaling system state at the given locomotive location. In a situation where signal states would indicate restrictive speeds ahead, the planner may elect to slow the train to conserve fuel consumption.

Information from the locator element 30' may also be used to change planning objectives as a function of distance to destination. For example, owing to inevitable uncertainties about congestion along the route, "faster" time objectives on the early part of a route may be employed as hedge against delays that statistically occur later. If it happens on a particular trip that delays do not occur, the objectives on a latter part of the journey can be modified to exploit the built-in slack time that was banked earlier, and thereby recover some fuel efficiency. A similar strategy could be invoked with respect to emissions restrictive objectives, e.g. approaching an urban area.

As an example of the hedging strategy, if a trip is planned from New York to Chicago, the system may have an option to operate the train slower at either the beginning of the trip or at the middle of the trip or at the end of the trip. The embodiment of the present invention would optimize the trip plan to allow for slower operation at the end of the trip since unknown constraints, such as but not limited to weather conditions, track maintenance, etc., may develop and become known during the trip. As another consideration, if traditionally congested areas are known, the plan is developed with an option to have more flexibility around these traditionally congested regions. Therefore, the embodiment of the present invention may also consider weighting/penalty as a function of time/distance into the future and/or based on known/past experience. Those skilled in the art will readily recognize that such planning and re-planning to take into consideration weather conditions, track conditions, other trains on the track, etc., may be taking into consideration at any time during the trip wherein the trip plan is adjust accordingly.

The database 36' illustrated in FIG. 11 may further be used to store characteristic information for each of the plurality of fuel types. Such characteristic information for each type of fuel for each locomotive consist includes one or more of fuel efficiency, emission rate, respective tank volume, cost availability, location availability, and any other characteristic of each type of fuel relevant in optimizing the performance of the locomotive consist.

FIG. 11 further illustrates a processor 44' operable to receive information from the locator element 30', the track characterization element 33', and the database 36'. Upon the processor 44' receiving the information, an algorithm 46' embodied within the processor 44' with access to the information creates a trip plan that optimizes the performance of the locomotive consist 42' in accordance with one or more operational criteria for the locomotive consist. Such operational criteria may include the departure time, arrival time, speed limit restrictions along the locomotive consist track, emission rate and mileage rate restrictions along the locomotive consist track, and any other criteria pertinent to the trip. The algorithm 46' is used to compute an optimized trip plan based on parameters involving the locomotive 42', train 31', track 34', and objectives of the mission. The algorithm 46' may create a trip plan based on models for train behavior as the train 31' moves along the track 34' as a solution of nonlinear differential equations derived from physics with simplifying assumptions that are provided in the algorithm. The algorithm 46' has access to the information from the locator element 30', track characterizing element 33', database 36' and/or sensors 38'.

For marine vehicles, the processor 44' would not consider information from a track characterization element 33', as track topography is not applicable to the path of the marine vehicle. However, the database 36' may include sound emission restrictions for each location, including port and non-port areas, based upon location information from the locator element 30'. The algorithm 46' for marine vehicles may create a trip plan for minimizing the total fuel consumed for all fuel types subject to the sound emission restrictions in each region, for example. For off-highway vehicles, the characterization element 33' may provide information for the topography of the predetermined course of the off-highway vehicle and the database 36' may include emission and mileage restrictions at each location, as with locomotives discussed above.

In an exemplary embodiment, the algorithm 46' creates a trip plan minimizing the total fuel consumed of all fuel types of the locomotive consist 42', subject to operational criteria for the locomotive consist, including emission rate limits over the trip, for example. For example, the algorithm 46' may create trip plan to minimize the total fuel consumed for each fuel type of the plurality of fuel types of the locomotive consist 42', subject to a maximum emission rate of 5.5 g/HP-hr, in addition to other operational criteria discussed above. More particularly, the algorithm 46' creates a trip plan minimizing the total fuel consumed of each fuel type of the plurality of fuel types, where the total fuel consumed includes a weighted sum with weighted coefficients of each respective fuel consumed of each respective type of fuel. In accordance with the equations disclosed in previous embodiments, the total fuel consumed may be calculated using an equation for the total fuel mileage rate, expressed as:

$$F=k_1*F_1+k_2*F_2+\ldots$$

where F is the total fuel efficiency (time rate) for all of the plurality of fuel types, $F_1$ and $F_2$ are the respective fuel efficiencies for fuels #1 and #2, and $k_1$ and $k_2$ are the respective weighted coefficients for fuels #1 and #2. Although the fuel efficiency time rate is given above, it may be converted to a fuel efficiency distance rate and the total fuel consumed may accordingly be computed by integrating F over the distance constituting the overall trip.

In minimizing the total fuel consumed for each fuel type, the algorithm 46' determines each respective weighted coefficient for each respective type of fuel for the trip plan that minimizes the total fuel consumed for the plurality of types of fuel of the locomotive consist 42'. For example, where the locomotive consist 42' operates on fuels #1 and #2, the algorithm 46' may create a trip plan minimizing the total fuel consumed for the locomotive consist 42' by determining a weighted coefficient for fuel #1 to be 0.3 and a weighted coefficient for fuel #2 to be 0.7. Each weighted coefficient for each type of fuel depends on various factors, including the respective fuel emission rate, time of the year, cost availability, reliability of the system when operating on each type of fuel, respective fuel tank volume, and location availability. The weighted coefficient varies with fuel emission rate since the particular trip and operational criteria may involve a particular low or high emission rate limit based on location, and consequently the respective fuel emission rate is considered when evaluating the weighted coefficient. The location availability and time of the year are considered, as one particular fuel may be plentiful during one particular season or a particular region, but rare in another season or region. As illustrated in FIG. 3, the respective tank volume is considered, as each respective fuel is held in respective fuel tanks 27,37 and their respective volume levels 29,39 in those tanks, coupled with the mileage rates, indicates the remaining fuel range for a respective fuel. The algorithm 46' compares whether the remaining range of a particular fuel with the distance to a future stop of the locomotive consist when computing each weighted coefficient, and whether that fuel is available to be re-filled at each particular stop.

In an exemplary embodiment, the algorithm 46' creates a trip plan minimizing the total emission output of each fuel type of the plurality of fuel types of the locomotive consist 42', subject to operational criteria for the locomotive consist, including mileage rate limits over the trip, for example. For example, the algorithm 46' may create trip plan to minimize the emission output for each fuel type of the plurality of fuel types of the locomotive consist 42' subject to a maximum mileage rate of 10 mpg, in addition to those other operational criteria discussed above. More particularly, the algorithm 46' creates a trip plan minimizing the total emission output of each fuel type of the plurality of fuel types, where the total emission output includes a weighted sum with weighted coefficients of each respective emission output of each respective type of fuel. In accordance with the equations disclosed in previous embodiments, the total emission output may be calculated using an equation for the total emission rate, expressed as:

$$E=I_1*E_1+I_2*E_2+\ldots$$

where E is the total emission rate (time rate or distance rate) for all of the plurality of fuel types, $E_1$ and $E_2$ are the respective emission rates for fuels #1 and #2, and $I_1$ and $I_2$ are the respective weighted coefficients for fuels #1 and #2.

In minimizing the total emission output for each fuel type, the algorithm 46' determines each respective weighted coefficient for each respective type of fuel for the trip plan that minimizes the total emission output for the plurality of types of fuel of the locomotive consist 42'. For example, where the locomotive consist 42' operates on fuels #1 and #2, the algorithm 46' may create a trip plan minimizing the total emission output for the locomotive consist 42' by determining a weighted coefficient for fuel #1 to be 0.8 and a weighted coefficient for fuel #2 to be 0.2. Each weighted coefficient for each type of fuel depends on various factors, including the respective fuel mileage rate, time of the year, cost availability, fuel reliability, respective fuel tank volume, and location availability, in terms of its raw availability in each location and regional restrictions, including emission restrictions in each location. The weighted coefficient varies with fuel mileage rate since the particular trip and operational criteria may involve a particular low or high fuel mileage limit, and consequently the respective fuel mileage rate is considered when evaluating the weighted coefficient. The location availability and time of the year are considered, as one particular fuel may be plentiful during one particular season or a particular region, but rare in another season or region. As illustrated in FIG. 11, the respective tank volume is considered as each respective fuel is held in respective fuel tanks 27',37' and their respective volume levels 29',39' in those tanks, coupled with the mileage rates, indicates the remaining range of a respective fuel. The algorithm 46' compares the remaining range of a particular fuel with the distance to a future stop of the locomotive consist when computing each weighted coefficient, and whether that fuel is available to be re-filled at each particular stop.

Although FIG. 11 illustrates respective fuel tanks 27',37' for respective fuel types, each fuel tank 27',37' may be used to hold different fuel types at different times during a locomotive trip. Each fuel tank 27',37' may include sensors for each fuel type. In an exemplary embodiment, each sensor may be used to identify which fuel type is within each fuel tank 27',37' at different times. The sensors may include sensors which identify a fuel type within each fuel tank 27',37' based upon information provided to the locomotive 10', including manual sensors, electronically transmitted fuel type information from a fuel source such as a railroad or adjacent locomotive, and location information where the fuel tank 27',37' is filled. The processor 44' may include fuel type information for each location where filling takes place. The sensors may further identify a fuel type within each fuel tank 27',37' based upon properties of the fuel type within each tank 27',37' detected by the locomotive. Such properties may include physical properties of each fuel type, including viscosity and density, for example, or chemical properties of each fuel type, including fuel value, for example. These properties of each fuel type may be detected by sensors or devices within the locomotive. The sensors may further identify a fuel type within each fuel tank 27',37' based upon locomotive performance characteristics, such as the locomotive engine performance for example, while assessing the input and output properties of each fuel type to the engine. For example, for the locomotive engine to produce 1000 HP, the fuel regulator may include a stored fuel A input requirement of 200 gallons, but a fuel B requirement of 250 gallons. Accordingly, the fuel type within each tank 27',37' may be identified by assessing the stored fuel input and output characteristics with the locomotive engine characteristics, for example.

Upon an algorithm 46' creating a trip plan and determining each weighted coefficient for each particular fuel for the plurality of fuel types, each weighted coefficient may be stored in the database 36' for subsequent retrieval when the locomotive consist 42' re-commences the trip. Additionally, the weighted coefficients may be shared with other similar locomotive consists with the same plurality of fuels partaking in similar trips for minimizing the total fuel consumed.

In addition, the algorithm 46' may create a trip plan establishing a desired trip time, and/or ensuring proper crew operating time aboard the locomotive consist 42'. In an exemplary embodiment, a driver, or controller element, 51' is also provided. As discussed herein the controller element 51' is used for controlling the train as it follows the trip plan. In an exemplary embodiment discussed further herein, the controller element 51' makes train operating decisions autonomously. In another exemplary embodiment the operator may be involved with directing the train to follow the trip plan.

A feature of the exemplary embodiment of the present invention is the ability to initially create and quickly modify on the fly any plan that is being executed. This includes creating the initial plan when a long distance is involved, owing to the complexity of the plan optimization algorithm. When a total length of a trip profile exceeds a given distance, an algorithm 46' may be used to segment the mission wherein the mission may be divided by waypoints. Though only a single algorithm 46' is discussed, those skilled in the art will readily recognize that more than one algorithm may be used where the algorithms may be connected together. The waypoint may include natural locations where the train 31' stops, such as, but not limited to, sidings where a meet with opposing traffic, or pass with a train behind the current train is scheduled to occur on single-track rail, or at yard sidings or industry where cars are to be picked up and set out, and locations of planned work. At such waypoints, the train 31' may be required to be at the location at a scheduled time and be stopped or moving with speed in a specified range. The time duration from arrival to departure at waypoints is called dwell time.

In an exemplary embodiment, the present invention is able to break down a longer trip into smaller segments in a special systematic way. Each segment can be somewhat arbitrary in length, but is typically picked at a natural location such as a stop or significant speed restriction, or at key mileposts that define junctions with other routes. Upon the algorithm 46' creating a trip profile within each segment, the weight coefficients for the total fuel consumed or the total emission output for each fuel among the plurality of fuels in each respective segment varies with the segment length.

Figure 12:
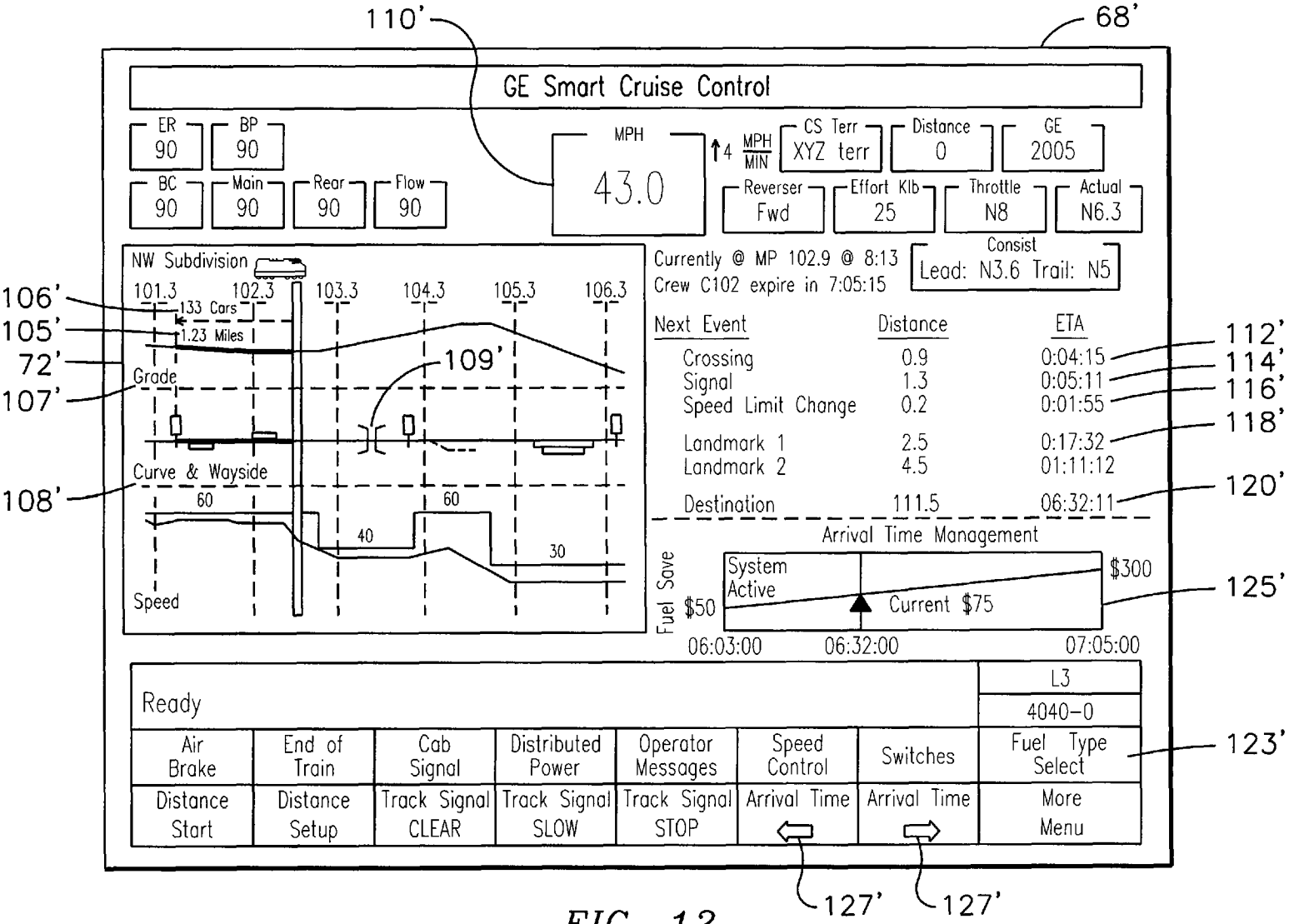
FIG. 12 depicts an exemplary illustration of a dynamic display for use by the operator.
Figure 13:
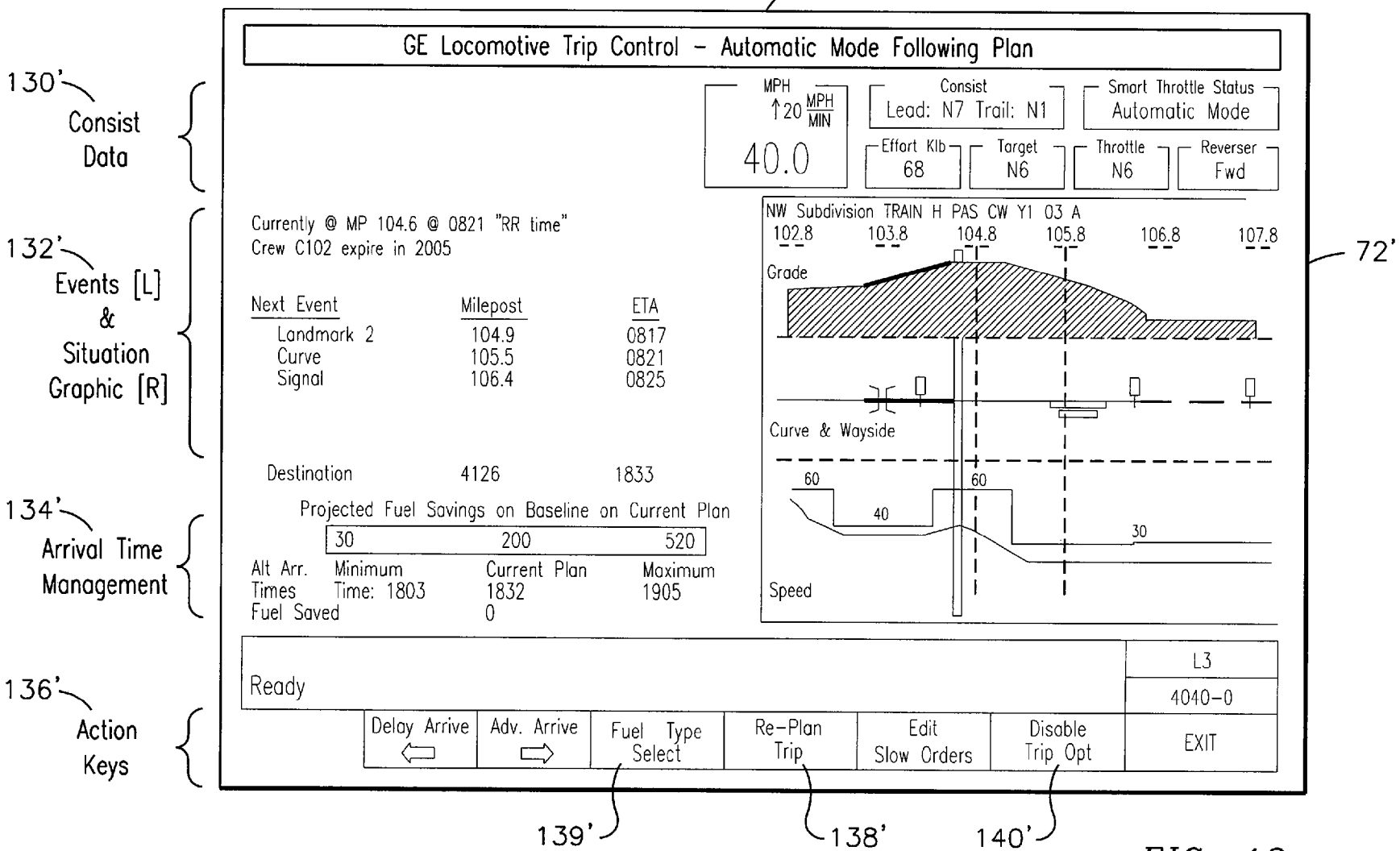
FIG. 13 depicts another exemplary illustration of a dynamic display for use by the operator.
Figure 14:
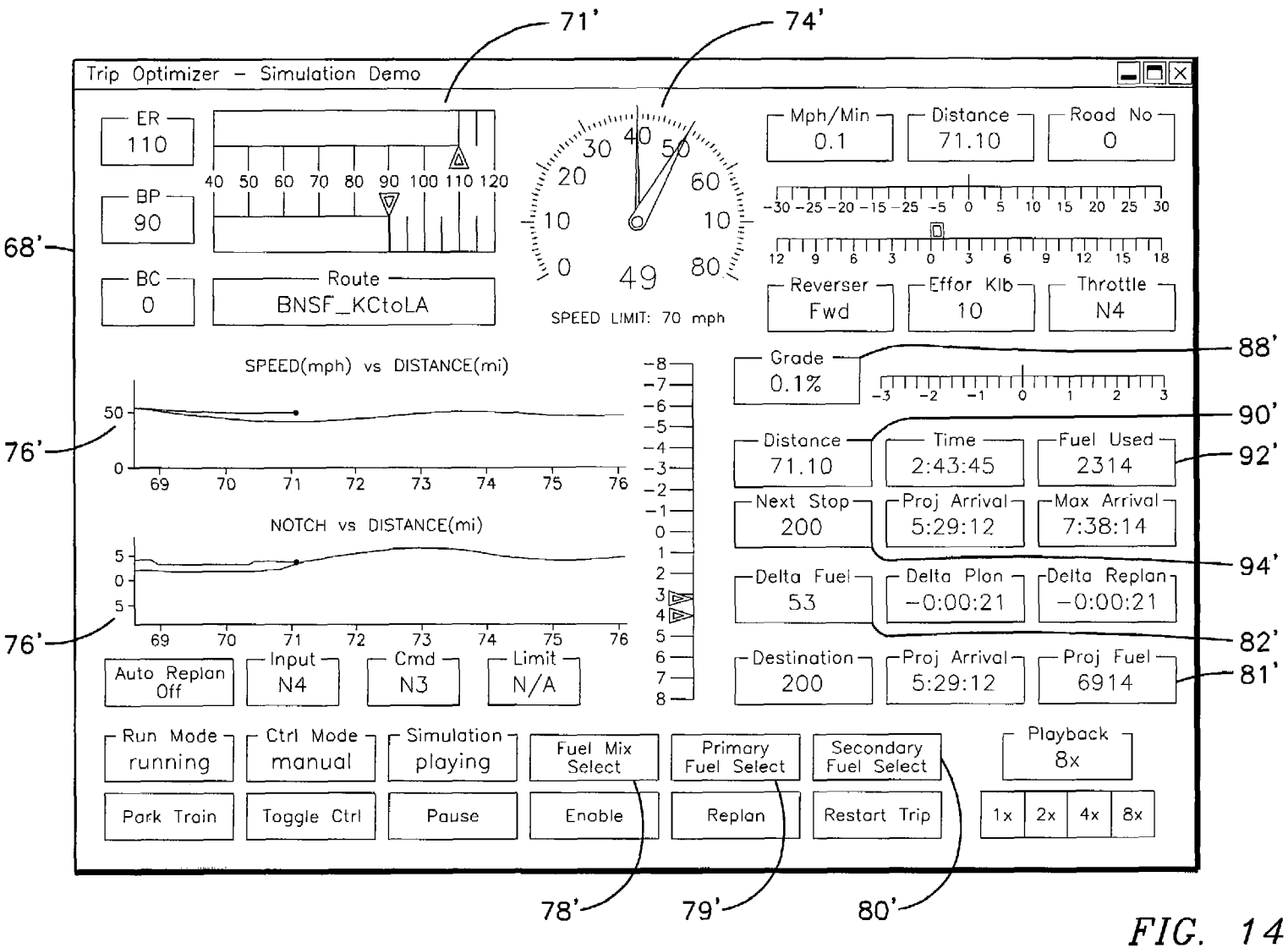
FIG. 14 depicts another exemplary illustration of a dynamic display for use by the operator.

Additionally, as illustrated in FIGS. 12-14, a user interface element 68' is connected to the processor and selectively displays the volume of each respective type of fuel of the plurality of fuel types. In FIG. 12, the user interface element 68' may select among the various types of fuels using a selection button 123', and view the cost savings for each particular fuel at an arrival time management portion 125' of the display 68'. In FIG. 13, the user may select among the various types of fuels using the select button 139' and view the projected cost savings for each particular fuel at the arrival time management portion 134' of the display 68'. Additionally, in FIG. 14, the user may select which fuel among the plurality of fuel types is primary and secondary. After designating the primary and secondary fuels, the user may push the primary fuel select button 79' to view the projected remaining miles 81' of primary fuel in its respective tank, and the amount of primary fuel behind/ahead of the trip plan, at the delta fuel portion 82'. Additionally, the user may push the secondary fuel select button 80' to view the projected remaining miles 81' of secondary fuel in its respective tank, and similarly the amount of secondary fuel behind/ahead of the trip plan, at delta fuel portion 82'. To view the projections of the mix of primary and secondary fuels, the user may push the fuel mix select button 78'. Those other elements of the system 10' not discussed herein, indicated with prime notation, are similar to those elements of the previous embodiments above, and require no further discussion herein.

Those other elements, not discussed in the system 10' embodiment of the present invention, are similar to those elements of the system 10 embodiment of the present invention discussed above, with prime notation, and require no further discussion herein.

Another embodiment of the present invention discloses a method for operating a vehicle. The vehicle may include a train 31' with one or more locomotive consists 42', as illustrated in FIG. 11, an off-highway vehicle (OHV), a marine vehicle, or any similar vehicle including an engine operating on a plurality of types of fuel. The plurality of types of fuel include one or more diesel based fuels and one or more alternate fuels. More particularly, each alternate fuel may include one of biodiesel, palm oil, and rape seed oil. Accordingly, the method for operating a train 31' with one or more locomotive consists 42' may be similarly applied to OHV's and marine vehicles.

Each locomotive consist 42' includes an engine operating on a plurality of fuel types. The method includes determining the location of the locomotive consist 42', providing information about a terrain (ie. track) 34' of the locomotive consist 42', and storing characteristic information for each type of fuel. More particularly, the method includes creating a trip plan that optimizes performance of the locomotive consist in accordance with one or more operational criteria for the locomotive consist.

The characteristic information for each type of fuel for each locomotive consist includes at least one of fuel efficiency, emission efficiency, respective tank volume, cost availability, and location availability.

Creating a trip plan includes minimizing the total fuel consumed of each type of fuel of the locomotive consist. More particularly, minimizing the total fuel consumed of each type of fuel includes minimizing a weighted sum having weighted coefficients of each respective fuel consumed of the plurality of fuel types. Additionally, the method includes determining the respective weighted coefficients for the trip plan that minimizes the total fuel consumed of each type of fuel of the locomotive consist.

Figure 15:
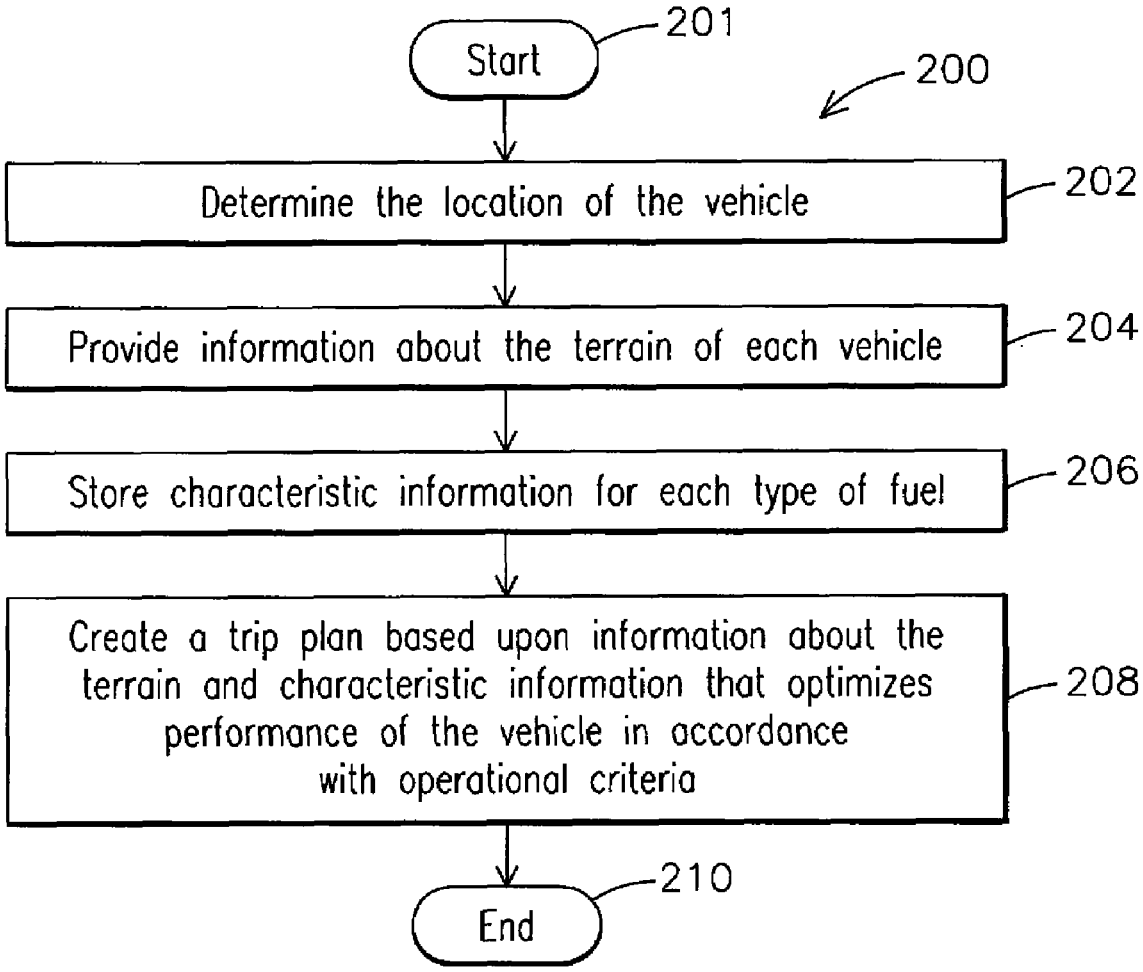
FIG. 15 is an exemplary embodiment of a method of the present invention.

FIG. 15 illustrates an embodiment of a method 200 for operating at least one vehicle 31', where each vehicle 31' includes an engine operating on at least one type of fuel. The method begins (block 201) by determining (block 202) the location of the vehicle, followed by providing (block 204) information about a terrain of each vehicle. Additionally, the method 200 includes storing (block 206) characteristic information for each type of fuel, and creating (block 208) a trip plan that optimizes performance of each vehicle in accordance with one or more operational criteria for the vehicle, before ending (block 210).

Based on the foregoing specification, an exemplary embodiment of the invention may be implemented using computer programming or engineering techniques including computer software, firmware, hardware or any combination or subset thereof, wherein the technical effect is to optimize performance of a vehicle in accordance with one or more operational criteria. Any such resulting program, having computer-readable code means, may be embodied or provided within one or more computer-readable media, thereby making a computer program product, i.e., an article of manufacture, according to an embodiment of the invention. The computer readable media may be, for instance, a fixed (hard) drive, diskette, optical disk, magnetic tape, semiconductor memory such as read-only memory (ROM), etc., or any transmitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will easily be able to combine the software created as described with appropriate general purpose or special purpose computer hardware, such as a microprocessor, to create a computer system or computer sub-system embodying the method of one embodiment of the invention. An apparatus for making, using or selling one embodiment of the invention may be one or more processing systems including, but not limited to, a central processing unit (CPU), memory, storage devices, communication links and devices, servers, I/O devices, or any subcomponents of one or more processing systems, including software, firmware, hardware or any combination or subset thereof, which embody an exemplary embodiment of the invention.

While the embodiment of the invention has been described in what is presently considered to be a preferred embodiment, many variations and modifications will become apparent to those skilled in the art. Accordingly, it is intended that the embodiment of the invention not be limited to the specific illustrative embodiment but be interpreted within the full spirit and scope of the appended claims.

What is claimed is:

1. A method for operating at least one vehicle, each vehicle including an engine operating on a plurality of fuel types, the method comprising:

a) determining the location of the vehicle;

b) providing information about a terrain of said at least one vehicle;

c) storing characteristic information for each of said plurality of fuel types;

d) creating a trip plan including minimizing the total fuel consumed of said plurality of fuel types of said at least one vehicle, based upon said information about the terrain and said characteristic information for each of said plurality of fuel types that optimizes performance of the at least one vehicle in accordance with one or more operational criteria for said at least one vehicle;

wherein said minimizing the total fuel consumed of said plurality of fuel types is performed by a processor, said minimizing the total fuel, comprises minimizing a weighted sum, said weighted sum being a sum of respective terms for each fuel type of said plurality of fuel types, said respective term being a product of a respective weighted coefficient and a respective fuel efficiency of each respective fuel consumed of said plurality of fuel types.

2. The method of claim 1, wherein said vehicle comprises one of a train having one or more locomotive consists, an off-highway vehicle (OHV) or a marine vehicle.

3. The method of claim 2, wherein said characteristic information for each of said plurality of fuel types for each vehicle comprises at least one of fuel efficiency, emission efficiency, respective tank volume, cost availability, and location availability.

4. The method of claim 1, further comprising determining said respective weighted coefficient for said trip plan that minimizes the total fuel consumed of each of said plurality of fuel types of said at least one vehicle.

* * * * *